US007364241B2

(12) United States Patent
Tomiyama

(10) Patent No.: US 7,364,241 B2
(45) Date of Patent: Apr. 29, 2008

(54) METHOD AND DEVICE FOR MANUFACTURING ROTARY BRUSH AND ROLL TOOTH BRUSH

(76) Inventor: Hideo Tomiyama, 24-1-13, Nagaomotomachi 3-chome, Hirakata-shi, Osaka 573-0163 (JP)

( * ) Notice: Subject to any disclaimer, the term of this patent is extended or adjusted under 35 U.S.C. 154(b) by 687 days.

(21) Appl. No.: 10/501,963

(22) PCT Filed: Jan. 28, 2003

(86) PCT No.: PCT/JP03/00801

§ 371 (c)(1),
(2), (4) Date: Jul. 19, 2004

(87) PCT Pub. No.: WO03/063644

PCT Pub. Date: Aug. 7, 2003

(65) Prior Publication Data

US 2005/0076460 A1 Apr. 14, 2005

(30) Foreign Application Priority Data

Jan. 28, 2002 (JP) ..... 2002-019212
Apr. 1, 2002 (JP) ..... 2002-099172

(51) Int. Cl.
*A46D 3/04* (2006.01)
*A46D 3/00* (2006.01)

(52) U.S. Cl. ..... 300/2; 300/21

(58) Field of Classification Search ..... 300/21, 300/2; 15/167.1, 27
See application file for complete search history.

(56) References Cited

U.S. PATENT DOCUMENTS 2,860,921 A * 11/1958 Van Clief, Jr. ..... 300/21
6,471,300 B1 * 10/2002 Tomiyama ..... 300/21

FOREIGN PATENT DOCUMENTS

| | | |
|---|---|---|
| JP | 2000-083736 | 3/2000 |
| JP | 2003-111618 | 4/2003 |
| WO | WO99/66815 | * 12/1999 |

* cited by examiner

*Primary Examiner*—Laura C Guidotti
(74) *Attorney, Agent, or Firm*—Vedder Price P.C.

(57) ABSTRACT

A method and a device for manufacturing a rotary brush for roll tooth brush capable of easily removing plaque, providing an excellent massage effect on gums, capable of being mass-produced, and capable of reducing a cost by uniformizing the density of the bristles of the rotary brush (11), the method for manufacturing the rotary brush comprising the steps of projecting, by a specified amount, a wire group (1) formed of a large number of resin wires (1*a*) assembled together in a bundle to the outside through an insert hole (2*a*) provided in a pedestal (2), inserting a cone (4) to the projected tip center of the wire group (1) to push open the wire group (1) in radial directions, welding the center portion of the wire group (1) in an annular shape with the push-opened wire group (1) fixed onto the pedestal (2), cutting the inside of the welded part to form a sheet-like brush unit (8) having a hub (81) at the center thereof and having a large number of bristles (wires) (82) projected from the hub toward the radial outer side, holdingly inserting a core pipe (9) into the hub (81) of the brush unit (8), and taking out the brush unit (8) together with the core pipe (9) from the pedestal (2) to the outside.

11 Claims, 21 Drawing Sheets

METHOD AND DEVICE FOR MANUFACTURING ROTARY BRUSH AND ROLL TOOTH BRUSH

TECHNICAL FIELD

The present invention relates to a method and a device for manufacturing a rotary brush for use in a roll toothbrush, and a roll toothbrush that are favorable for removing plaque deposited onto teeth and for massaging of gums.

BACKGROUND ART

The present inventor has priorly proposed a roll toothbrush favorable for removing plaque deposited onto teeth and for massaging of gums, and a manufacturing method therefor (Japanese Published Unexamined Patent Application No. H12-83736). With this roll toothbrush, one end of a wire group formed by assembling a plurality of wires of nylon, etc., together in a bundle is heat welded to form a semispherical welded part, and this welded part is thereafter flattened by pressurizing. A part of the flattened part to become an axial hole is then cut out and pressurized further to make the entirety of the wire group and the flattened part substantially circular. The ends of the flattened part are then joined together by welding, etc., thereby forming an annular part, and a sheet-like brush unit is thus prepared. By then connecting a plurality of the brush units obtained in this manner by joining the annular parts of the brush units, a roller-like rotary brush is formed. This rotary brush is supported rotatably via a supporting shaft at one end of a handle member, thereby arranging a roll toothbrush.

Since the rotary brush manufactured in the above manner requires expertise in making the thickness of the annular part thereof uniform and making the bristle density of the rotary brush uniform and requires processes difficult to mechanize, consistent and continuous manufacture is difficult to realize and thus mass production is difficult and the manufacturing cost is high.

The present invention thus improves on the above proposition, and an object of the present invention is to provide a method and a device for manufacturing a rotary brush for use in a roll toothbrush, and a roll toothbrush, which enable the bristle density of the rotary brush to be made uniform, thereby providing excellent effects in removing plaque deposited onto teeth and massaging of gums, and yet enable cost reduction.

DISCLOSURE OF THE INVENTION

In order to achieve the above object, a first aspect of the invention provides a brush unit manufacturing method, which is for manufacturing a sheet-like brush unit for forming the above-described rotary brush and comprises the steps of: projecting, by a specified amount, a wire group formed by assembling together a plurality of wires in a bundle outward through an insert hole provided in a pedestal; inserting a cone into the center of the projected end of the wire group to push open the wire group in radial directions; welding a center portion of the wire group in an annular shape with the pushed-open wire group being fixed to the pedestal; and cutting the inner side of the annular welded part; to form a sheet-like brush unit having a hub at the center thereof and having a plurality of bristles (wires) projecting radially from the hub.

A second aspect of the invention provides a rotary brush manufacturing method comprising the steps of: projecting, by a specified amount, a wire group formed by assembling together a plurality of wires in a bundle outward through an insert hole provided in a pedestal; inserting a cone into the center of the projected end of the wire group to push open the wire group in radial directions; welding a center portion of the wire group in an annular shape with the pushed-open wire group being fixed to the pedestal; cutting the inner side of the welded part to form a sheet-like brush unit having a hub at the center thereof and having a plurality of bristles (wires) projecting radially from the hub; making a core pipe be inserted in and hold the hub of the brush unit; and taking out the brush unit, together with the core pipe, to the exterior of the pedestal; and repeating these steps to make the core pipe insertingly hold a plurality of brush units, thereby forming a roll-like rotary brush with a plurality of bristles projecting radially.

By the above, a rotary brush for roll toothbrush, which is uniform in bristle density and excellent in the effects of removing plaque and massaging gums, can be obtained at low cost in a continuous and efficient manner.

In the above-described manufacturing method, the tips of the bristles of the rotary brush are preferably trimmed to uniform length and subject to a finishing treatment as well. An even better rotary brush can thereby be obtained.

A fourth aspect of the invention provides a brush unit manufacturing device for rotary brush comprising: a pedestal having an insert hole through which a wire group formed by assembling together a plurality of wires in a bundle is to be passed; a chuck for grasping the wire group and holding the wire group so that it projects outward from the insert hole of the pedestal by a specified amount; a cone to be inserted into the center of the projected end of the wire group to push open the wire group in radial directions; a pressing member for fixing the pushed-open wire group to the pedestal; a welder for welding a center portion of the wire group in an annular shape with the wire group being fixed to the pedestal; and a cutting machine for cutting the inner side of the welded part of the wire group.

A fifth aspect of the invention provides a rotary brush manufacturing device comprising: a pedestal having an insert hole through which a wire group formed by assembling together a plurality of wires in a bundle is to be passed; a chuck for grasping the wire group and holding the wire group so that it projects outward from the insert hole of the pedestal by a specified amount; a cone to be inserted into the center of the projected end of the wire group to push open the wire group in radial directions; a pressing member for fixing the pushed-open wire group to the pedestal; a welder for welding a center portion of the wire group in an annular shape with the wire group being fixed to the pedestal; a cutting machine for cutting the inner side of the wire group while leaving the welded part to form a sheet-like brush unit having a hub at the center thereof and having a plurality of bristles (wires) projecting in outwardly radial directions from the hub; and a pipe handling machine for making a core pipe be inserted in and hold the hub of the brush unit and taking out the brush unit, together with the core pipe, to the exterior of the pedestal.

By using this machine, the method of this invention can be put into practice readily and the intended object can be achieved.

The above device is preferably equipped with a cutter for cutting the bristles of the rotary brush to uniform length while rotating the rotary brush, and a finishing machine, which rounds the tips of the bristles. An even better rotary brush can thereby be obtained.

A seventh aspect of the invention provides a sheet-like brush unit for roll toothbrush, which is overlaid in plurality to form a rotary toothbrush and wherein a wire group is formed by assembling together a plurality of wires in a bundle and pushing open the wires in radial directions, a center portion of the wire group being welded in annular shape with the pushed-open wire group being fixed to a pedestal to form a welded part and the inner periphery of the annular welded part being cut in circular form to form a circular insert hole.

An eighth aspect of the invention provides a rotary brush for roll toothbrush, wherein sheet-like brush units for roll toothbrush are formed respectively by forming a wire group by assembling together a plurality of wires in a bundle and pushing open the wires in radial directions, welding a center portion of the wire group in annular shape with the pushed-open wire group being fixed to a pedestal to form a welded part, and cutting the inner periphery of the annular welded part in circular form to form a circular insert hole, the abovementioned sheet-like brush units are overlaid in plurality, and a core pipe is inserted into the insert hole.

A ninth aspect of the invention provides a roll toothbrush, wherein sheet-like brush units for roll toothbrush are formed respectively by forming a wire group by assembling together a plurality of wires in a bundle and pushing open the wires in radial directions, welding a center portion of the wire group in annular shape with the pushed-open wire group being fixed to a pedestal to form a welded part, and cutting the inner periphery of the annular welded part in circular form to form a circular insert hole, a rotary brush is formed by overlaying the above-mentioned sheet-like brush units in plurality and inserting a core pipe into the insert hole, and the rotary brush is supported in a rotatable manner in a handle member.

A tenth aspect of the invention provides a roll toothbrush manufacturing method comprising the steps of: projecting, by a specified amount, a wire group formed by assembling together a plurality of wires in a bundle outward through an insert hole provided in a pedestal;

inserting a cone into the center of the projected end of the wire group to push open the wire group in radial directions;

welding a center portion of the wire group in an annular shape with the pushed-open wire group fixed to the pedestal;

cutting the inner side of the annular welded part to form a sheet-like brush unit having a hub at the center thereof and having a plurality of bristles (wires) projecting radially from the hub;

making a core pipe be inserted in and hold the hub of the brush unit;

taking out the brush unit, together with the core pipe, to the exterior of the pedestal;

repeating these steps to make the core pipe insertingly hold a plurality of the brush units, thereby forming a roll-like rotary brush with a plurality of bristles projecting radially; and making the rotary brush be supported in a rotatable manner in a handle member.

This invention also provides a method for manufacturing a rotary toothbrush, wherein a rotary brush, which is in turn formed by overlaying a plurality of brush units, is mounted in a rotatable manner to a handle member, comprising the steps of: projecting, by a specified amount, a wire group formed by assembling together a plurality of wires in a bundle outward through an insert hole provided in a pedestal; blowing air into the center of the projected end of the wire group to open up the wire group in radial directions; welding a center portion of the wire group with the opened-up wire group being fixed to the pedestal; cutting off a central part of the welded center portion to form a brush unit; and concentrically overlaying the brush units in plurality to form a rotary brush; and thereafter mounting the rotary brush to a handle member.

This invention also provides a method for manufacturing a brush unit for rotary brush, which is overlaid in plurality to form a rotary brush, comprising: a first step of projecting, by a specified amount, a wire group formed by assembling together a plurality of wires in a bundle outward through an insert hole provided in a pedestal; a second step of blowing air into the center of the projected side of the wire group to open the wire group in radial directions; a third step of welding a center portion of the wire group with the opened wire group being fixed to the pedestal; and a fourth step of cutting off a central part of the welded center portion.

With the above method, each step can be processed in a standardized manner, enabling a brush unit of uniform thickness to be manufactured without a high degree of skill. By opening up the wire group in radial directions using air from a nozzle, the overlapping of the wires that make up a brush unit is practically eliminated and a brush unit of uniform thickness can be manufactured. The possibility of damaging of the wires is also lessened even when the brush unit manufacturing speed is increased, and since this enables the opening up of the wire group to be carried out at high speed, efficient manufacture of brush units at high speed is enabled. After welding the center portion of the wire group that has been opened up in radial directions, the central part of the welded center portion is cut off. The shape of the central part can thus be formed uniformly, thereby enabling uniform brush units to be manufactured. Also by performing the step of opening up the wire group in radial directions by blowing air into the central part of the projected end of the wire group, the opening up of the wire group and the cutting of the central part can be performed with the same member, thereby enabling simplification of the device and simplification of the operating system. Uniformalization and mass production of rotary toothbrushes are thereby enabled.

This invention also provides a device for manufacturing a brush unit for rotary brush, which is overlaid in plurality to form a rotary brush, comprising: a pedestal having an insert hole through which a wire group formed by assembling together a plurality of wires in a bundle is to be passed; a chuck for grasping the wire group and holding the wire group so that it projects outward from the insert hole of the pedestal by a specified amount; a nozzle for blowing air into the center of the projected end of the wire group to open up the wire group in radial directions; a pressing member for fixing the opened-up wire group to the pedestal; a welder for welding a center portion of the wire group with the pushed-open wire group fixed to the pedestal; and a cut-off means for cutting off a central part of the welded part welded by the welder.

By using this device, the method of this invention can be put into practice readily and the intended object can be achieved.

The abovementioned chuck is preferably formed of a casing and a cylindrical resilient member positioned in the interior of the casing, and arranged so that the resilient member is expanded or compressed by the supplying or discharge of air into or out from the interior of the casing to grasp or release the wire group that has been inserted into the interior. The structure of the abovementioned chuck can thereby be simplified. The work operation of projecting the wire group outward from the insert hole of the pedestal can be performed simply and yet definitely, and this work operation can be performed simply and definitely with a single chuck.

Also, the abovementioned nozzle is provided in the interior thereof with an air passage for blowing air into the central part of the projected end of the wire group and preferably has the abovementioned cut-off means formed on the outer periphery of the tip thereof so that both the actions of blowing air and cutting off the central part of the welded part are performed with a single member. With this arrangement, the arrangement of the device as a whole is simplified and the moving/operation system for the abovementioned nozzle and cut-off means is simplified. That is, in a case where a member for pushing open the wire group, a welder, and a cutting machine are used, the device becomes complex as a whole. Since these three equipments need to be moved independently of each other, the moving/operation system therefore becomes complex. On the other hand, where the cut-off means is formed integrally on the nozzle, the entire device and the moving/operation system can be simplified. To be more specific, since the abovementioned nozzle and cut-off means are formed integrally as a single block, it becomes sufficient to move and operate just this block and the welder and the moving/operation system therefor can be simplified.

Furthermore, the abovementioned nozzle and welder are preferably mounted on a single frame and arranged to be moved in the left/right and up/down directions via this frame. The arrangement of the entire device is simplified by this arrangement as well, and the moving/operation system for the abovementioned nozzle and welder are also simplified.

Also, it is preferable to mount to the above mentioned pedestal a slide blade for cutting and removing the remaining welded part of the wire group that has been cut by the cut-off means from the wire group of the next stage. This slide blade is preferably provided with an inclining face for applying a force in the direction in which the remaining welded part of the wire group is extracted from the pedestal. Though the remaining welded part of a wire group tends to become attached to and remain on the pedestal side, with the above arrangement, due to a force applied in the direction in which the remaining welded part of the wire group is extracted from the pedestal by the inclining face provided on the sliding blade when the remaining welded part of the wire group is removed by cutting with the slide blade, the remaining part of the wire group will not become attached and remain on the pedestal and can be taken out speedily to the exterior by means of the slide blade. The wire group following the remaining welded part can thereby be inserted into the insert hole of the pedestal without fail, and the transition to the next work step can be carried out speedily.

BEST MODE FOR CARRYING OUT THE INVENTION

An embodiment of this invention shall now be described based on the drawings.

Figure 1:
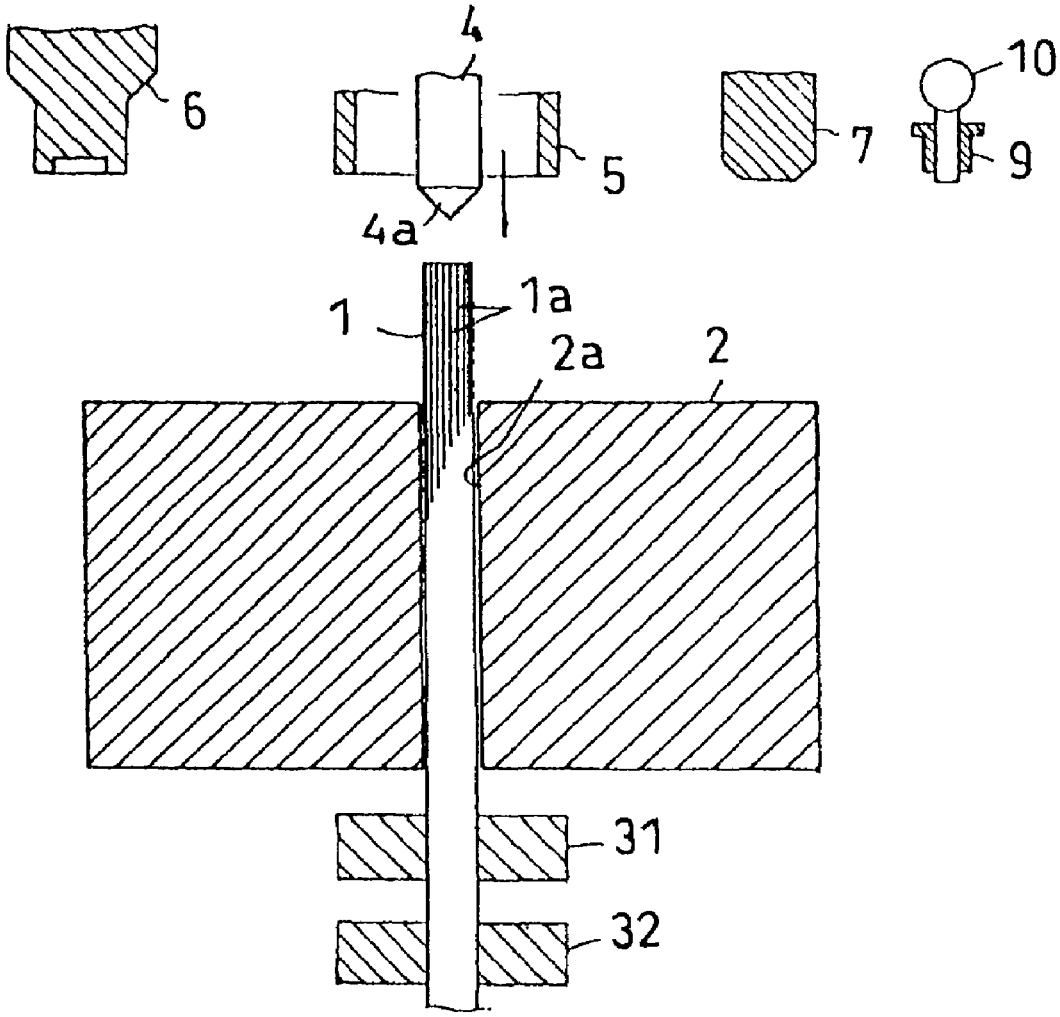
FIG. 1 is a sectional view showing the principal parts of a manufacturing device for manufacturing a rotary brush by this invention's manufacturing method.

FIGS. 1 through 9 show the respective steps of manufacturing a rotary brush by this invention's manufacturing method. FIG. 1 shows the principal parts of a manufacturing device for carrying out this method. That is, this device is equipped with a pedestal 2 having an insert hole 2*a* for passing through a wire group 1, an upper/lower pair of first and second chucks 31 and 32 disposed in a vertically movable manner at the lower side of the pedestal for grasping and releasing the wire group 1, a cone 4 disposed above the insert hole 2*a* of the pedestal 2 to be inserted into the center of the inserted upper side of the wire group 1, which is projected upward by a specified amount from the insert hole 2*a* of the pedestal 2 by the grasping and upward movement of the respective chucks 31 and 32, to push open the wire group 1 in radial directions, and a cylindrical pressing member 5 also disposed above the pedestal 2 for fixing the pushed-open wire group 1 above the pedestal 2.

Also above the pedestal 2 are provided a welder 6, which, for example, is of an ultrasonic type and welds a center part of the wire group 1 with the wire group 1 being fixed on the pedestal 2, a cutting machine 7 for cutting the interior of the welded part of the wire group 1 while leaving at least a part thereof, and a pipe handling machine 10 for inserting a core pipe 9 into a brush unit 8 formed of the wire group 1 by means of the welder 6 and the cutting machine 7, insertingly holding a plurality of brush units and taking out each brush unit 8 along with the core pipe 9 to the exterior of the pedestal 2 after insertion and holding. The pipe handling machine 10 is arranged so that when the core pipe 9 is inserted in and made to hold a predetermined number of brush units 8, this core pipe 9 is removed and then another single core pipe 9 is successively taken out from an unillustrated holder for housing a plurality of core pipes 9 and set in the pipe handling machine 10.

Though in FIG. 1, the welder 6, the cutting machine 7, and the pipe handling machine 10 are shown as being separated from the position above the wire group 1 in the left/right directions, in performing a process, each component is moved to the position above the wire group 1 by means of a horizontal moving means to perform the required process. Oppositely, the pedestal may be moved in the horizontal direction instead.

First, as shown in FIG. 1, the wire group 1 formed by assembling together wires 1*a* made of a thermoplastic resin, such as nylon, etc. in a bundle is grasped by the above-mentioned first and second chucks 31 and 32, and by the upward movement of these chucks, the wire group 1 is held in a state in which it is projected upward by a specified amount from the insert hole 2*a* of the pedestal 2. The movements of these chucks 31 and 32 shall be described in detail later.

Figure 2:
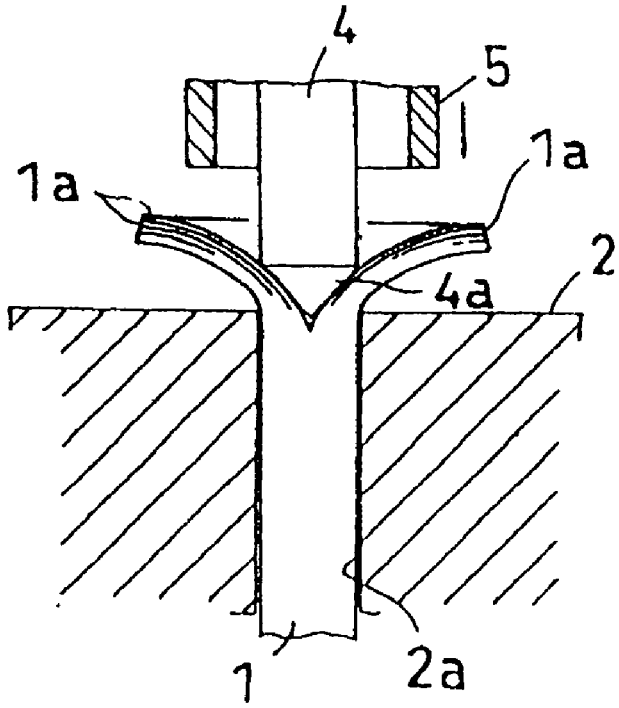
FIG. 2 is a sectional view showing a step of pushing open a wire group with a cone.
Figure 3:
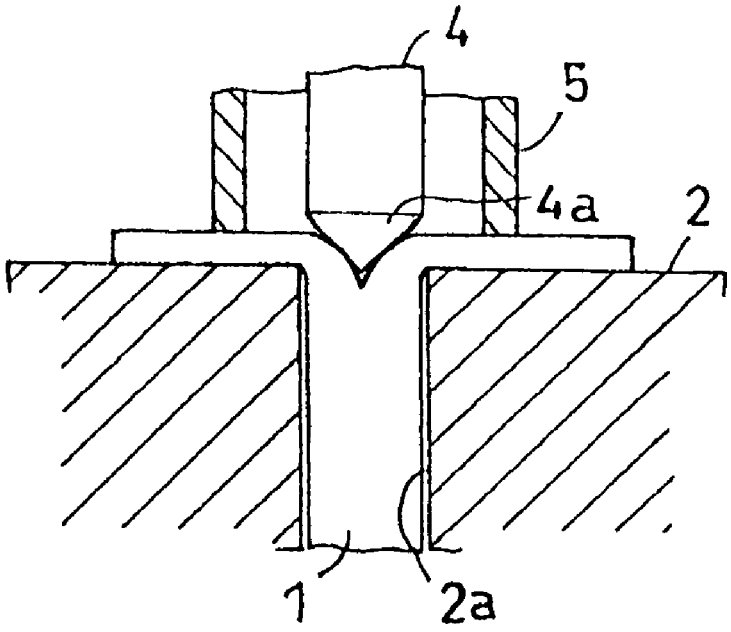
FIG. 3 is a sectional view showing a step of pushing open by means of the cone and holding by means of a pressing member.

Then as shown in FIG. 2, the abovementioned cone 4 descends and a conical protrusion 4*a* at the lower end thereof is inserted into the center of the projected upper end of the wire group 1 and the wire group 1 is thereby pushed open in radial directions. Subsequently, the abovementioned pressing member 5 descends and the wire group 1 is thereby fixed onto the pedestal 2 in a pushed-open state.

The pressing member 5 has, for example, a cylindrical lower end face. The pressing member 5 presses a somewhat outer side of a central part of the wire group 1 that has been pushed open in radial directions. A spatial allowance for the entry of the tip of the welder is left at the inner side of the pressing member 5 so as to enable the insertion of the welder 6 after the cone 4 with a downward-directed conical protrusion being retreated in the state in which the pressing member 5 is pressing. The pressing member 5 sandwiches the wire group against the pedestal 2 and holds the wire group firmly so that it will not move.

Figure 4:
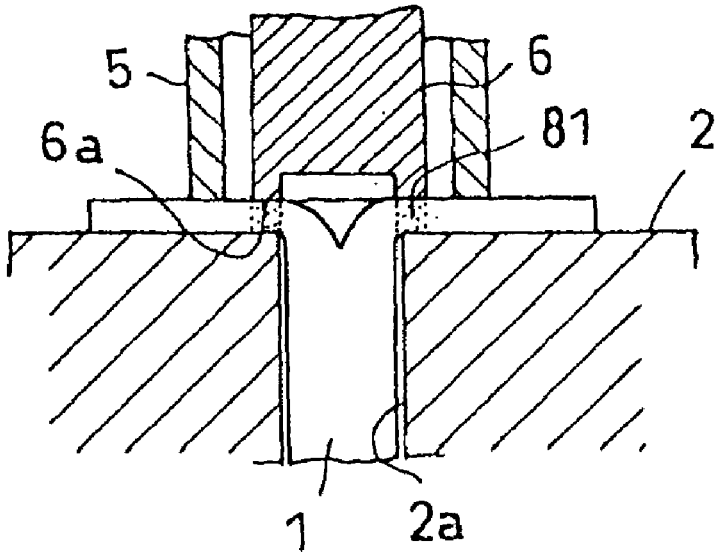
FIG. 4 is a sectional view showing a step of holding by means of the pressing member and welding with a welder.

Thereafter, as shown in FIG. 4, the abovementioned cone 4 retreats with the pushed-open wire group 1 being fixed on the pedestal 2 by the pressing member 5. Subsequently, the abovementioned welder 6 is moved to the position directly above the center of the wire group 1 and is inserted into the interior of the pressing member 5, and the central part of the pushed-open wire group 1 is welded in annular shape by the tip of the welder 6.

As the welder, a type that uses ultrasonic waves is used favorably, and this welder is equipped with a circular welding part 6*a* at its tip and pressingly welds the wire group 1 pushed open between the pressing member 5 and the pedestal 2 at the inner side of the pressing member. The inner circumference of the welded part 81 formed by welder 6 is preferably matched with the upper rim 2*b* of the insert hole 2*a*.

Figure 5:
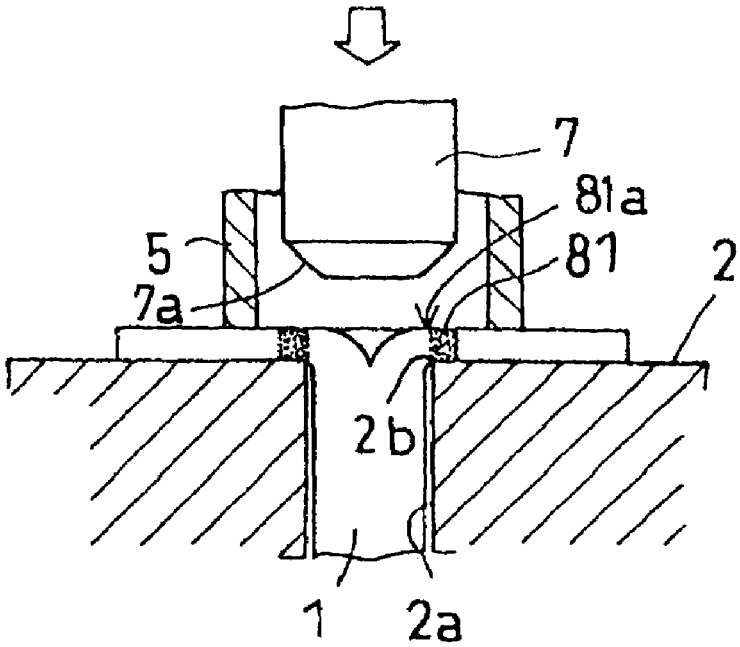
FIG. 5 is a sectional view showing a step of cutting the inner side of a welded part.

After welding, as shown in FIG. 5, the above-mentioned welder 6 is retreated, and subsequently the above-mentioned cutting machine 7 is moved to the position directly above the center of the wire group 1 and is inserted into the interior of pressing member 5, and by the tip of the cutting machine 7, an inner circumferential part 81*a* of the welded part 81 of the pushed-open wire group 1 is cut in circular form.

With the cutting machine 7 of the illustrated embodiment, the outer peripheral surface of the tip is formed to a truncated conical surface 7*a* inclined with respect to the central line, and the wire group is sandwiched and cut between this truncated conical surface 7*a* and the upper rim 2*b* of the circular insert hole 2*a* of the pedestal 2. By arranging so that the wire group is sandwiched and cut between the truncated conical surface 7*a* and the upper rim 2*b* of the insert hole 2*a*, it has become possible to manufacture a brush unit of uniform thickness and to perform cutting in a continuously repeating manner. The truncated conical surface 7*a* and the upper rim 2*b* of the insert hole 2*a* are formed of a material having the required hardness, etc., or are subject to a prescribed heat treatment to enable the cutting process to be repeated a larger number of times.

Figure 6:
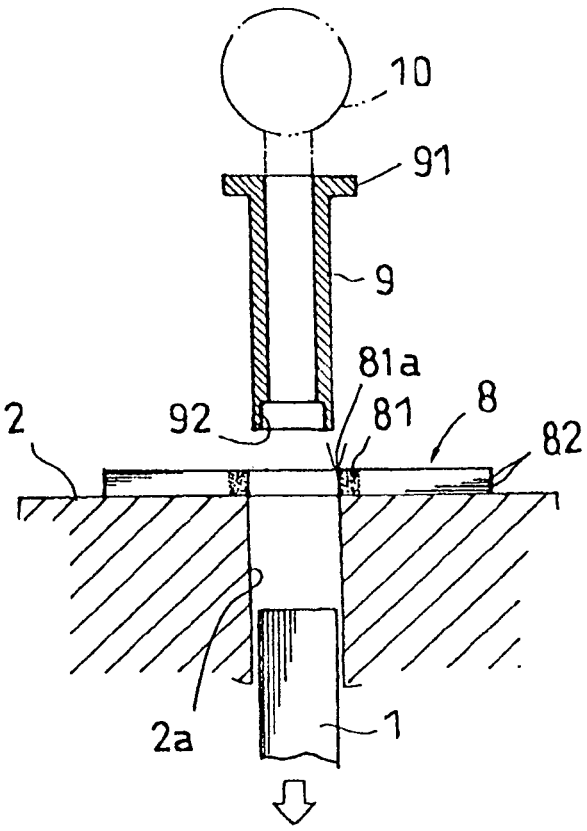
FIG. 6 is a sectional view showing a step in which a core pipe 9 is inserted in and made to hold a brush unit 8.

A sheet-like brush unit 8 having a hub (welded part) 81 at the center thereof and having a plurality of bristles (wires) 82 projecting in radial directions from the hub 81 is thereby formed (see FIG. 6). The above-described welding of the central part of the wire group 1 by the welder 6 and the cutting of the inner part of the welded part by the cutting machine 7 may be carried out in reverse order. That is, the center portion of the wire group 1 may be cut in circular form by the cutting machine 7 and then the circumference thereof may be welded in annular shape by the welder 6.

Since the wire group 1 is thus welded in annular shape with it being fixed on the pedestal and the inner side of the welded part is cut with the wire group likewise being fixed on the pedestal, the thickness of the welded part 81 is finished uniformly.

Figure 7:
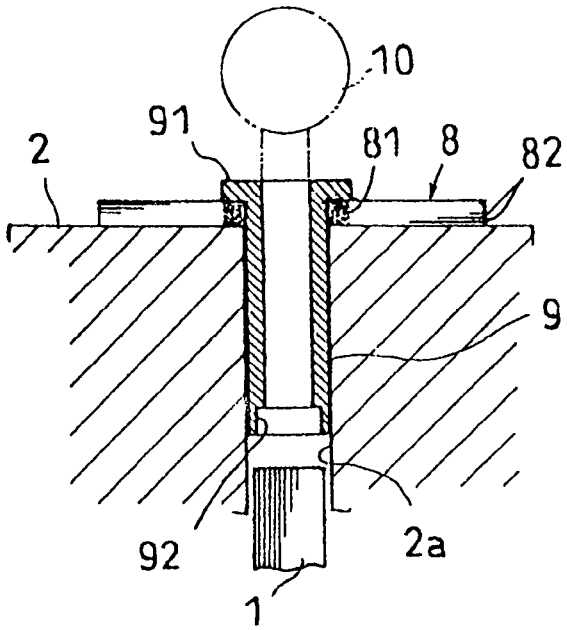
FIG. 7 is a sectional view showing the step in which a core pipe 9 is inserted in and made to hold a brush unit 8.

Thereafter, the abovementioned first and second chucks 31 and 32 both descend while still grasping the wire group 1 and the wire group 1 is thus retreated once downwards into the interior of the insert hole 2*a* as shown in FIG. 6. Subsequently, the pipe handling machine 10, in the state in which it holds a core pipe 9, is moved to the position immediately above the center of the hub 81 of the brush unit 8 that has been made on the pedestal 2. As shown in FIG. 7, by the descending of the pipe handling machine 10, the core pipe 9 is inserted via hub 81 into the insert hole 2*a* of the pedestal 2 and the core pipe 9 is thereby made to insertingly hold brush unit 8.

After the core pipe 9 is made to insertingly hold the brush unit 8, the pipe handling machine 10 rises, thereby taking out the brush unit 8 along with the core pipe 9 to the exterior of the pedestal 2, and the pipe handling machine 10 then waits at a predetermined upper position.

When the abovementioned wire group 1 has been retreated once downwards inside the insert hole 2*a*, the second chuck 32 is opened and moved downward with the first chuck 31 being closed. After being moved downward by a predetermined amount, the second chuck is closed so as to grasp the wire group 1 again. The first chuck 31 is thereafter opened and the second chuck 32 is raised to a predetermined position. After the rise to the predetermined position, the first chuck 31 is closed. When these operations end, both chucks 31 and 32 are raised so that the wire group 1 grasped by these chucks is held while projecting upwards by a specified amount from the insert hole 2*a* of the pedestal 2. The wire group 1 can thereby be held in a manner whereby the specified amount thereof is projected upwards from the insert hole 2*a* of the pedestal 2 without causing the dropping of the wire group 1 downwards.

Figure 8:
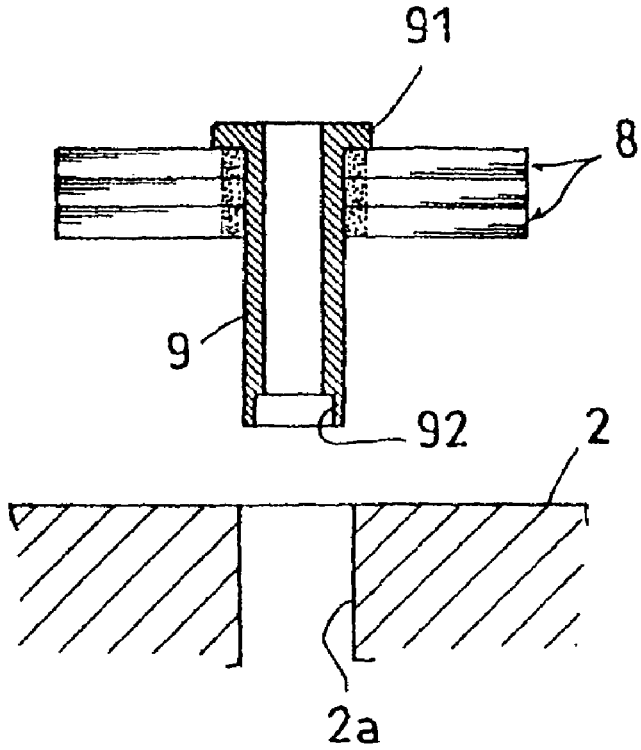
FIG. 8 is a sectional view showing a step wherein core pipe 9 insertingly holds a predetermined number of brush units 8.
Figure 9:
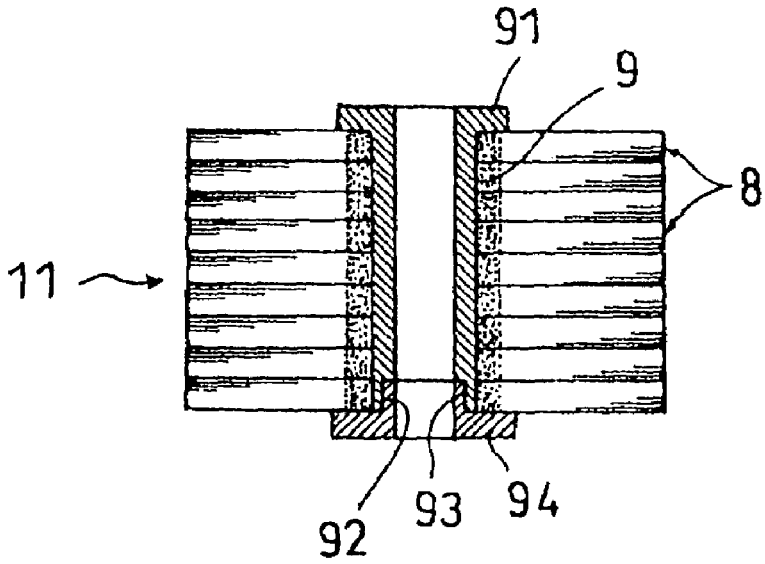
FIG. 9 is a sectional view showing a rotary brush wherein core pipe 9 insertingly holds a predetermined number of brush units 8.

By the repetition of these steps, the core pipe 9 is made to insertingly hold brush units 8 successively as shown in FIG. 8. Then after the core pipe 9 is made to insertingly hold a predetermined number of the brush units 8, the core pipe 9 and the brush units 8 are removed from the pipe handling machine 10, and a new core pipe 9 is taken out from the holder and set in the pipe handling machine 10. After being taken out from the pipe handling machine 10, the brush units 8 are fixed to the core pipe 9 as shown in FIG. 9. With the embodiment of the respective figures, a core pipe 9 made of nylon or other thermoplastic resin and having a collar 91 formed integrally at one end in the length direction and an annular receiving groove 92 formed at the other end side, is used, and is inserted into brush units 8 successively from the receiving groove 92 side with the collar part 91 being positioned upward. Then after insertingly holding the predetermined number of the brush units 8, a cylindrical lid 94, made of the same material as the above-described core pipe 9 and having a protrusion 93 to be inserted in the abovementioned receiving groove 92, is used and the protrusion 93 thereof is inserted into the receiving groove 92, and the predetermined number of brush units 8 are fixed onto the core pipe 9 by joining the lid 94 to the core pipe 9 by a sealing means using ultrasonic waves, etc., to prepare the rotary brush 11.

Figure 10:
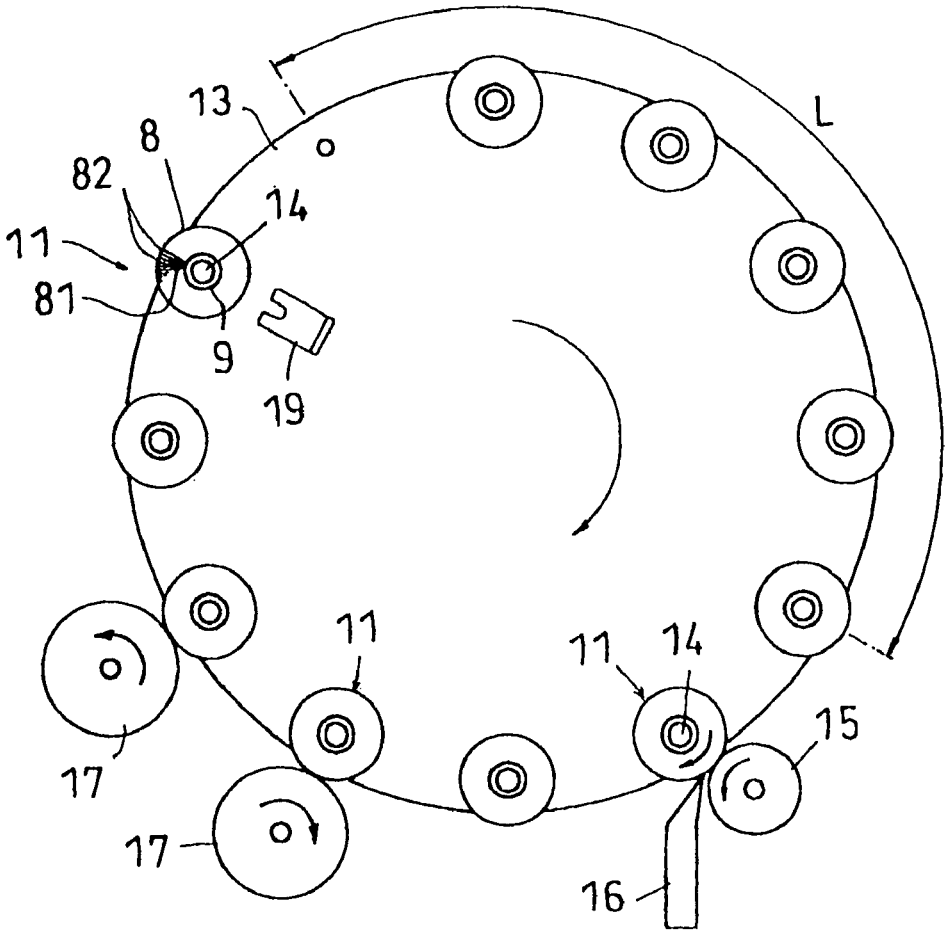
FIG. 10 is a plan view of a device used for post-processing of a rotary brush.
Figure 11:
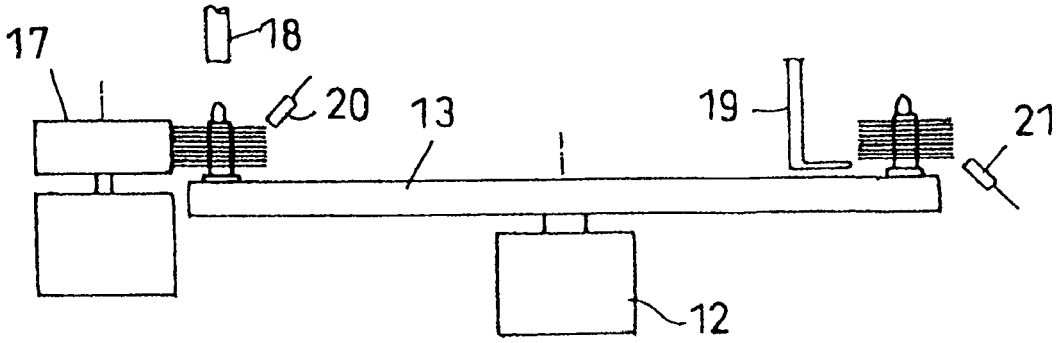
FIG. 11 is a side view showing the principal parts of the same device in an exploded manner.

FIG. 10 is a plan view of a device used for post-processing of the rotary brush 11 and FIG. 11 is a side view showing the principal parts of the same device in an exploded manner. In these figures, a plurality of pins 14 insertable into the core pipes 9 of the above-described rotary brushes 11 are protruded from the upper outer circumferential parts of a turntable 13 driven to rotate in the direction of the arrow R by a motor 12. At outer peripheral positions of the turntable 13 are positioned a rubber roller 15, which contacts a rotary brush 11 in which a pin 14 is inserted, and a clipper or other cutter 16. With the rotary brush 11, in which the pin 14 is inserted, rotated by means of the abovementioned rubber roller 15, the tips of bristles 82 of the rotary brush 11 are trimmed to uniform length by the abovementioned cutter 16.

Also, at positions of the turntable 13 rearward the cutter 16 in the direction of rotation are positioned two front and rear grinders or other finishing machines 17 that contact the tips of the bristles 82 of the rotary brush 11 in which the pin 14 is inserted. By forward rotation and reverse rotation of these finishing machines 17, the tips of the bristles 82 of the rotary brush 11 are rounded.

Furthermore with the embodiment of the respective figures, a removal prevention member 18 for the rotary brush 11 is positioned above the finishing machines 17, and at a position of the turntable 13 rearward the finishing machines 17 in the direction of rotation is positioned a take-out machine 19, which takes out the finished rotary brush 11 from the pin 14. In FIG. 11, 20 denotes a sensor that checks the setting of a rotary brush 11 on a pin 14 and drives finishing machines 17, and 21 denotes a sensor for checking the taking out of a rotary brush 11 from a pin 14 by the take-out machine 19. In FIG. 10, L indicates the range along the turntable 13 in which rotary brushes 11 are set on pins 14.

Figure 12:
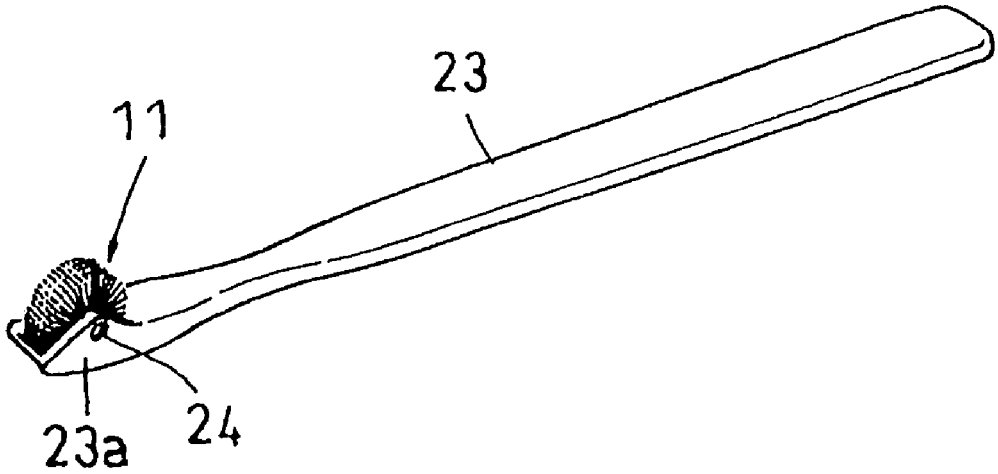
FIG. 12 is a perspective view showing a roll toothbrush fitted with a rotary brush.

FIG. 12 is a perspective view showing a roll toothbrush 22 fitted with a rotary brush 11 that has been obtained as described above. This toothbrush 22 is formed by the abovementioned rotary brush 11 being supported rotatably via a supporting shaft 24 at one end in the length direction of a handle member 23.

Figure 13:
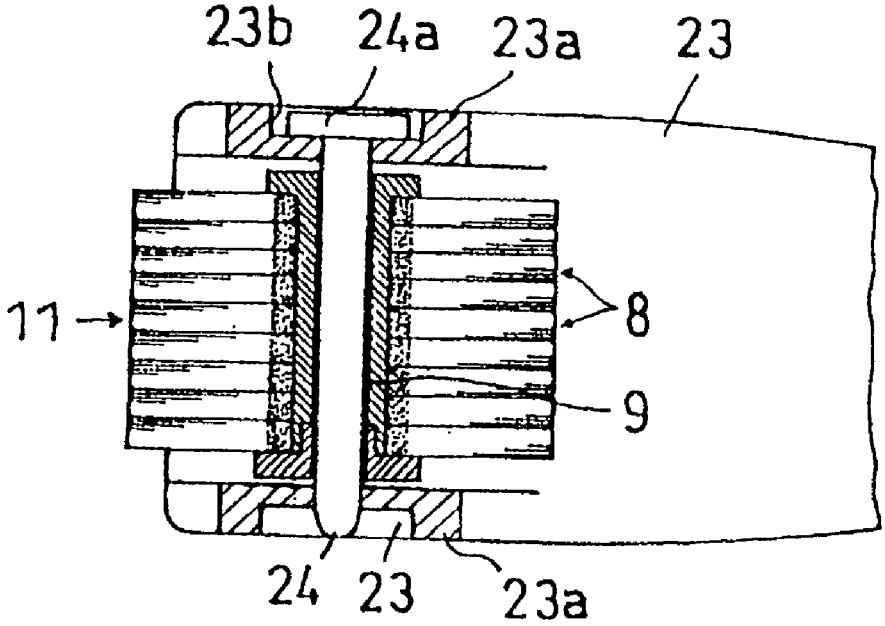
FIG. 13 is partial sectional view for describing a state wherein the rotary brush is mounted to a handle to arrange the roll toothbrush.
Figure 14:
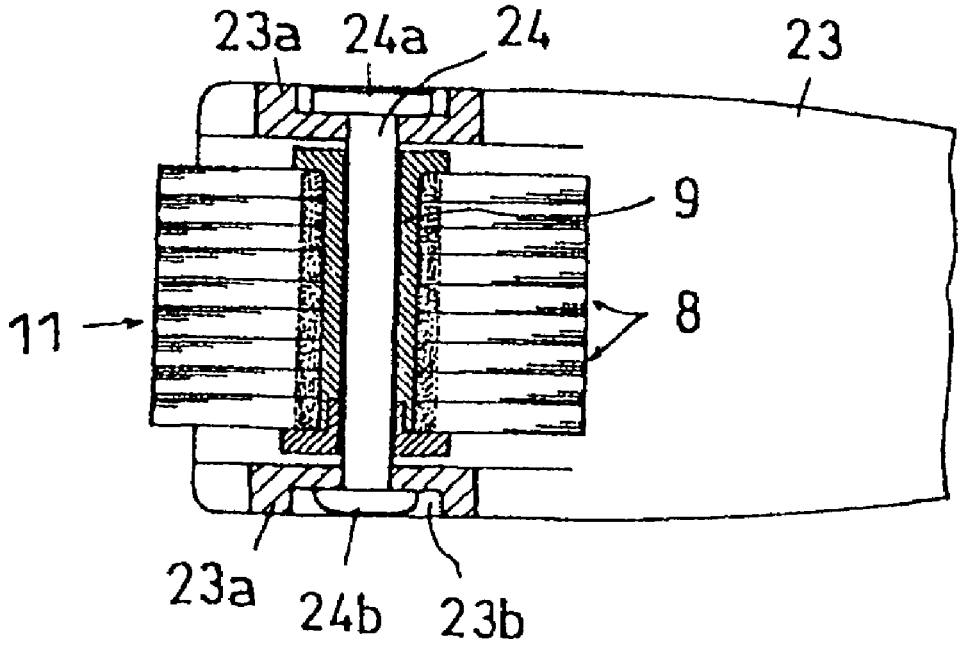
FIG. 14 is partial sectional view for describing the state wherein the rotary brush is mounted to the handle to arrange the roll toothbrush.

FIG. 13 and FIG. 14 are sectional views for describing the states in which a rotary brush 11, which has been obtained as described above, is set in a handle member 23 of a roll toothbrush 22. First as shown in FIG. 13, the rotary brush 11 is interposed between supporting pieces 23*a* formed at both sides of one end in the length direction of the handle member 23, and then the supporting shaft 24 having a head part 24*a* is inserted from one supporting piece 23*a* to the other supporting piece 23*a* through the core pipe 9 of the rotary brush 11. The other end side of the supporting shaft 24 is thereafter squashed so that the rotary brush 11 is rotatably supported in the handle member 23 via the supporting shaft 24.

With the embodiment of the respective figures, concaves 23*b* are formed in the respective supporting pieces 23*a* of the abovementioned handle member 23, and the head part 24*a* of the abovementioned supporting shaft 24 and the squashed part 24*b* at the other side are positioned in these concaves. The head part 24*a* of the abovementioned supporting shaft 24 is preferably made noncircular in shape and the abovementioned concaves 23*b* of the supporting piece 23*a* that receives it is also preferably made noncircular in shape, and by arranging thus, the rotary brush 11 can be made to rotate smoothly about the supporting shaft 24.

Another embodiment of this invention shall now be described.

Figure 15:
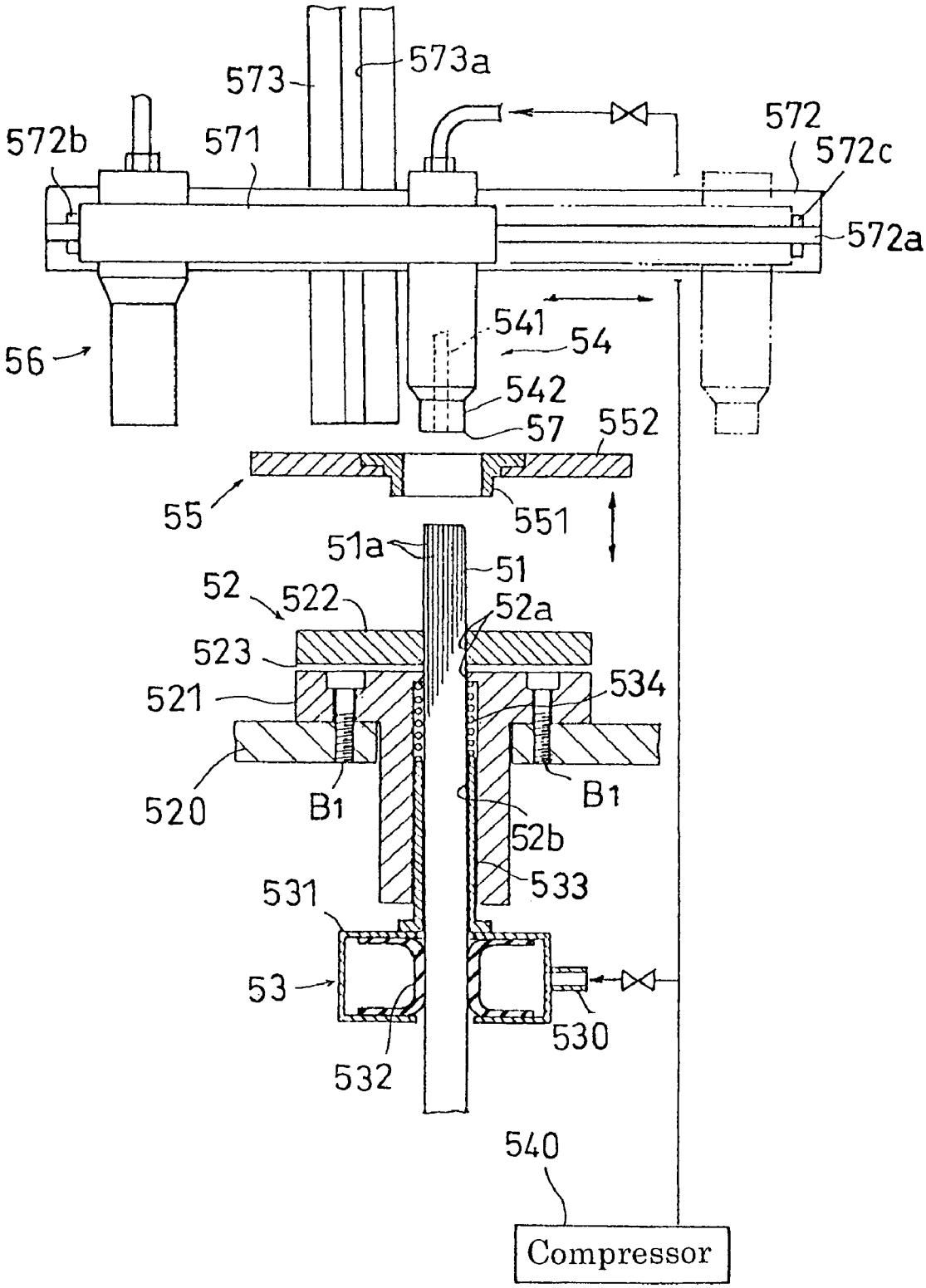
FIG. 15 is a partially cutaway front view showing this invention's device for manufacturing a brush unit for rotary brush.

FIG. 15 is a partially cutaway front view showing this invention's device for manufacturing a brush unit for a rotary brush to be used in a rotary toothbrush. This device is equipped with a pedestal 52 having an insert hole 52*a* for passing through a wire group 51 formed by assembling together wires 51*a*, for example, of nylon or other thermoplastic resin in a bundle, and a chuck 53 disposed in a vertically movable manner at the lower side of the pedestal 52 for grasping and releasing the wire group 51.

Also above the pedestal 52 are equipped a nozzle 54 for blowing air into a central part of the inserted upper end of the wire group 51, which is projected by a specified amount above the insert hole 52*a* of the pedestal 52 by the grasping and upward movement of the abovementioned chuck 53, to open up the wire group 51 in radial directions, a pressing member 55 for fixing the opened-up wire group 51 onto the pedestal 52, a welder 56, which is, for example, of an ultrasonic type and welds a center part of the wire group 51 with the wire group 51 being fixed on the pedestal 52 by the pressing member 55, and a cut-off means 57 for cutting off a central part of the welded part of the wire group 51 while leaving at least a part of the welded part.

The abovementioned chuck 53 is equipped with a casing 531 having an air supply/discharge pipe 530 connected to a compressor 540, and a cylindrical resilient member 532 positioned in the interior of the casing, which is made of rubber, etc., and has collars provided at its upper and lower sides. By the expansion or contraction of the resilient member 532 by the supplying or discharge of air from the pipe 530 into the abovementioned casing 531, the wire group 51 that has been inserted inside the chuck 53 is grasped or released. By then moving upward the chuck 53 with the wire group 51 being grasped by the resilient member 532, the wire group 51 is projected upward by the specified amount from the insert hole 52*a* of the pedestal 52. Also, upon being projected by the specified amount, the wire group 51 is opened up in radial directions by the air from the nozzle 54. After this opened-up wire group 51 is fixed onto the pedestal 52 by the abovementioned pressing member 55, the chuck 53 releases the wire group 51 and then returns to the original downward position. With this arrangement, the structure can be simplified since just one chuck 53 suffices. The work operation of making the wire group 51 be projected outward from the insert hole 52*a* of the pedestal 52 can be performed in a simple and yet definite manner.

The abovementioned nozzle 54 has an air passage 541, which is connected to the abovementioned compressor 540, formed in the central interior thereof. By the blowing of air from this air passage 541 onto the central part of the projected end of the abovementioned wire group 51, the wire group 51 is opened up in radial directions. Also, the abovementioned cut-off means 57 is formed integrally on an outer peripheral part of this nozzle 54. That is, a cylindrical protrusion 542 is formed at the front end side of the nozzle 54 and by hardening, etc., a front outer peripheral thereof, the front outer peripheral part of the protrusion 542 is made into the above-mentioned cut-off means 57. By this arrangement, the arrangement of the device as a whole is simplified and the moving/operation system for the abovementioned nozzle 54 and the cut-off means 57 is also simplified.

With the embodiment of FIG. 15, the nozzle 54 having the abovementioned cut-off means 57 and the welder 56 are mounted to a first frame 571, which extends in the transverse direction. This first frame 571 is supported in a manner enabling movement to the left and right in a transverse groove 572*a* formed in a second frame 572 that extends in the same direction, and the abovementioned second frame 572 is supported in a manner enabling upward and downward movement in a vertical groove 573*a* formed in a third frame 573 that extends in the vertical direction, to enable the abovementioned nozzle 54 and welder 56 to move in the two-dimensional directions of left, right, up, and down. This arrangement also simplifies the arrangement of the device as a whole and also simplifies the moving/operation system for the abovementioned nozzle 54 and the welder 56. The abovementioned nozzle 54 and the cut-off means 57 are thus arranged as a single block as described above, and since it suffices to move and operate just the two components of this block and the welder 56 in the two-dimensional directions between left and right limit positions 572*b* and 572*c*, the moving/operation system therefor can be simplified.

Figure 16:
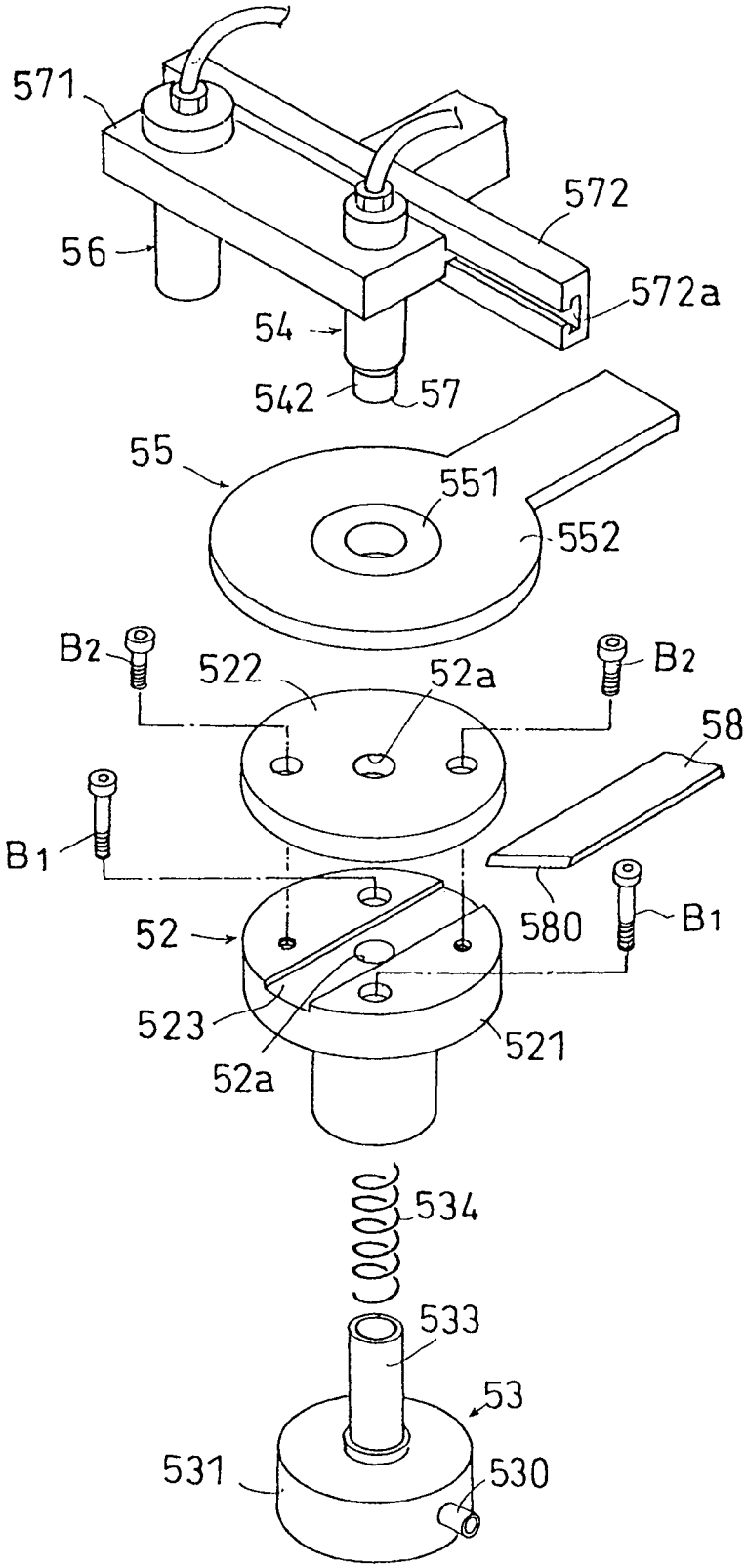
FIG. 16 is a perspective view showing the principal parts of the same manufacturing device and showing the part of a pedestal in an exploded manner.

FIG. 16 is a perspective view showing the principal parts of the manufacturing device and shows the part of the abovementioned pedestal 52 in an exploded manner. This pedestal 52 comprises a disk-like first member 521 joined onto a fixed base 520 (see FIG. 15) by means of a plurality of bolts B1 and a disk-like second member 522 joined above the first member 521 by means of a plurality of bolts B2, and the insertion hole 52*a* for passing through the abovementioned wire group 51 is formed in central parts of these first and second members 521 and 522.

Also, on the upper surface of the abovementioned first member 521 is formed a slide groove 523, which passes through a central part of the first member 521 in a throughgoing manner in the diameter direction, and in this slide groove 523 is mounted a slide blade 58, which cuts and removes a remaining welded part 51*a* (see FIG. 23) of the wire group 51 that has been cut by the cut-off means 57 formed on the above-described nozzle 54. This slide blade 58 has the inclining face 580, which extends rearward from the blade edge in an upwardly inclining manner, formed at its tip, and by this inclining face 580, a force in the direction of extracting the remaining welded part 51*b* (see FIG. 23) of the wire group 51 from the insert hole 52*a* of the pedestal 52 is applied.

Also as shown in FIG. 15, the insert hole 52*a* formed in the abovementioned first member 521 has an inwardly directed collar part 5211 formed at the upper end, and below this, the diameter is made large in comparison to the inner diameter of the inwardly directed collar part 5211. Into this enlarged diameter part 52*b*, a cylindrical member 533, which is protruded upward from a central part of the abovementioned chuck 53, is inserted in a manner enabling upward and downward movement, and a coil spring 534 is interposed between this cylindrical member 533 and an upper end part of the abovementioned enlarged diameter part 52*b*. The inner diameters of the above-mentioned cylindrical member 533 and the coil/spring 534 are made substantially the same as that of the abovementioned insert hole 52*a*. The wire group 51 is arranged to be inserted from the interiors of the cylindrical member 533 and coil spring 534 to the insert hole 52*a* in the above-described first and second members 521 and 522.

By this arrangement, when the wire group 51 is projected upwards from the insert hole 52*a* by means of the above-described chuck 53, the wire group 51 can be fed smoothly without becoming caught in the insert hole 52*a*. The wire group 51 is thus projected upwards from the insert hole 52*a*, opened up in radial directions by the air from the nozzle 54, and welded by the welder 56 while being fixed onto the pedestal 52 by the pressing member 55. Thereafter, the central part of the wire group 51 is cut off by the cut-off means 57 while leaving at least a part of the welded part, and in this process, the cut-off part is pushed inside the insert hole 52*a* (see FIG. 22). And though a part of the wire group 51 tends to become expanded in outwardly radial directions inside the insert hole 52*a* due to the cut-off part, by the provision of the cylindrical member 533 and the coil spring 534 as described above, the expansion of the wires in the outwardly radial directions is prevented and the wire group 51 can thereby be fed upward smoothly by the chuck 53 without becoming caught inside the insert hole 52*a*. Moreover, the length of the coil spring 534 is made longer than the vertical length of the enlarged diameter part when the cylindrical member 533 is lowered the most. The expansion of the wires can thereby be prevented at any position when the cylindrical member moves up and down.

Also, the abovementioned pressing member 55 comprises a cylindrical main pressing member body 551 having at its center an insert hole 551*a* through which the above-described nozzle 54 and the welder 56 are inserted, and a supporting member 552, which supports the main pressing member body 551 with a part of the main pressing member body 551 being projected downwards. This supporting member 552 is connected to an unillustrated vertical movement mechanism, and by this vertical movement mechanism, the entirety of the pressing member 55 is moved in the up/down directions along a central line that passes through the center of the insert hole 52*a* of the above-described pedestal 52.

FIGS. 17 through 23 show the respective steps for manufacturing a brush unit for rotary brush by this invention's manufacturing method.

Figure 17:
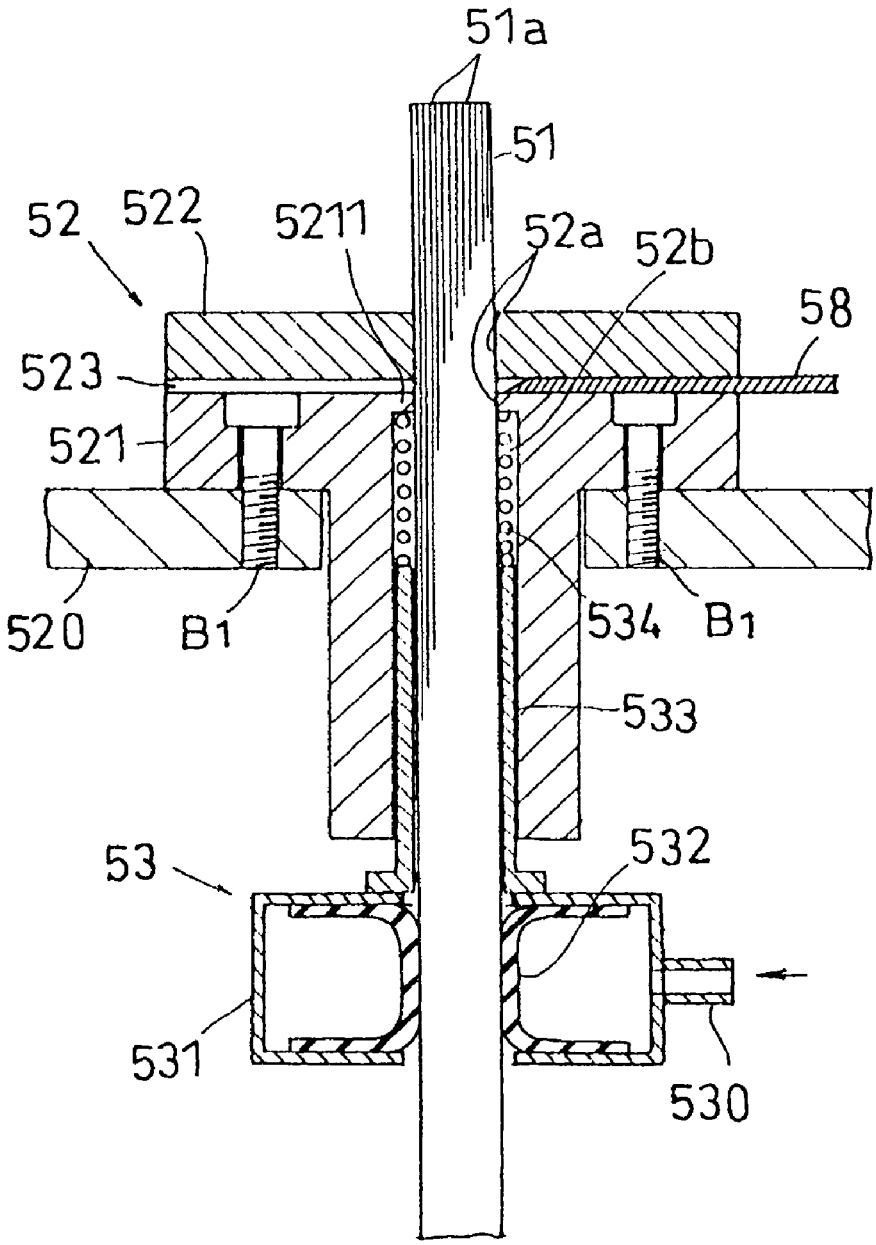
FIG. 17 is a sectional view showing a first step for manufacturing a rotary brush by this invention's manufacturing method.

First as shown in FIG. 17, air is supplied from the compressor 540 (FIG. 15) into the casing 531 of the above-described chuck 53 and by the inward expansion of the resilient member 532 disposed inside, a wire group 51 is grasped. Thereafter the above-described chuck 53 moves upwards and the wire group 51 is held with a specified amount projected upward from the insert hole 52*a* of the pedestal 52 (first step).

Figure 18:
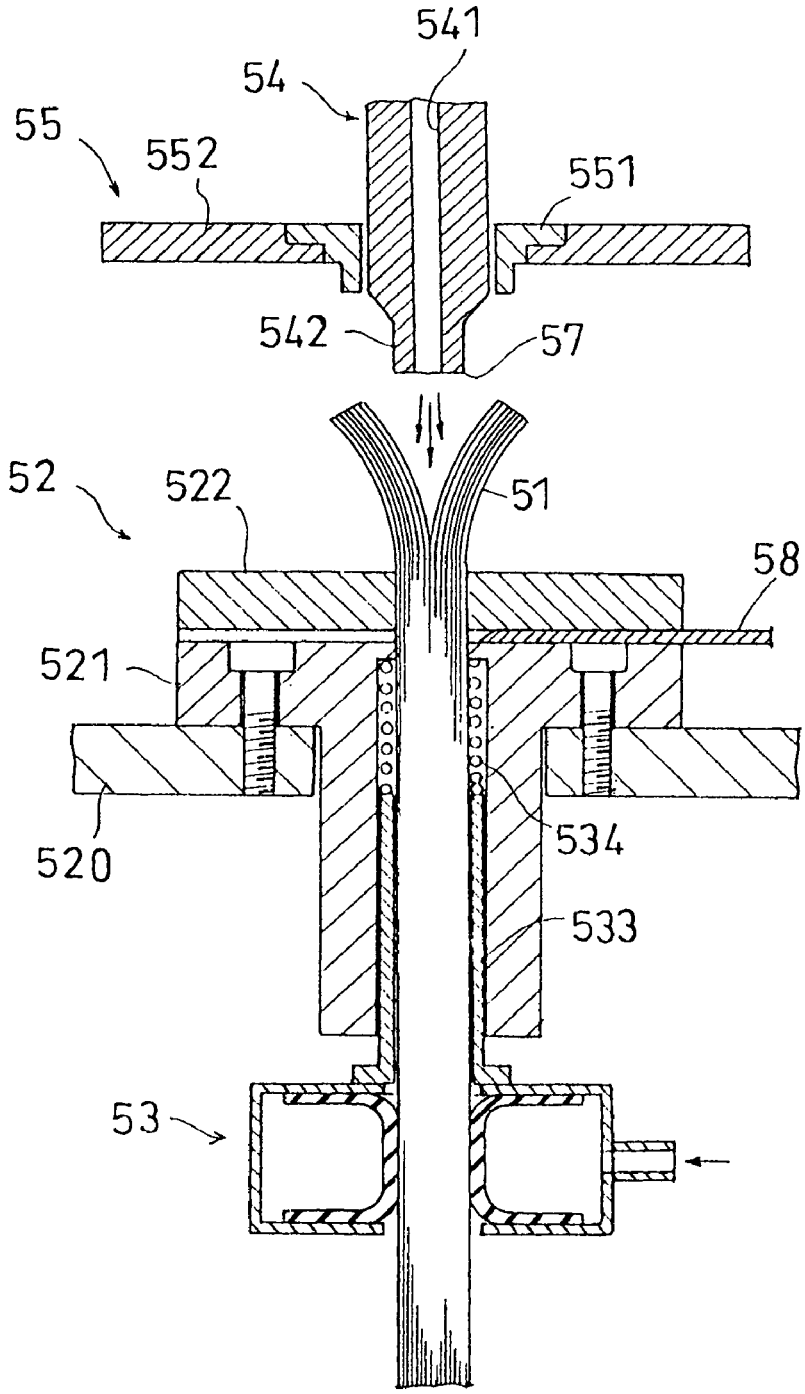
FIG. 18 is a sectional view showing a part of a second step.
Figure 19:
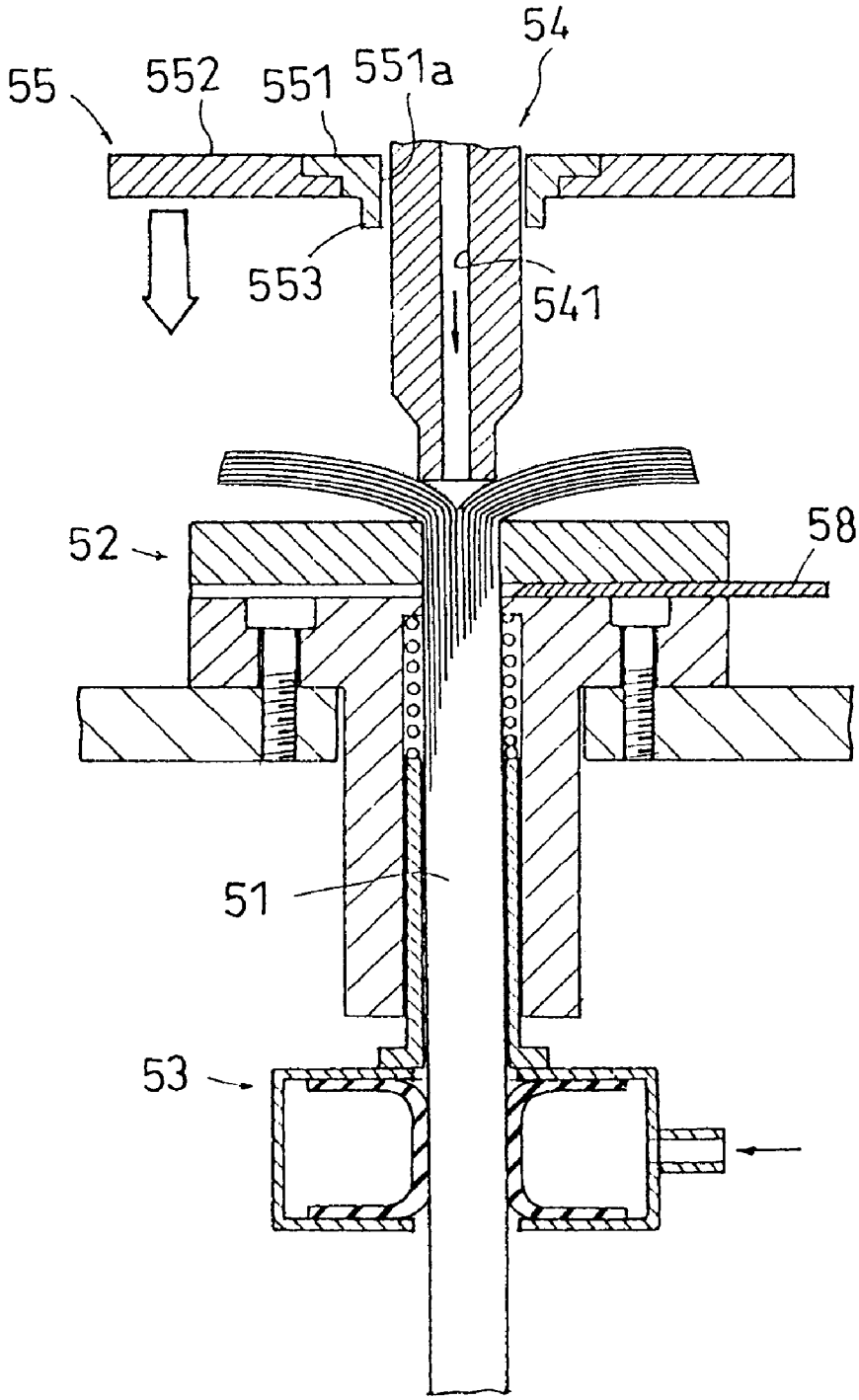
FIG. 19 is a sectional view showing a part of the second step.

The first frame 571 of FIG. 15 then moves transversely along the groove 572*a* of the second frame 572, and when the nozzle 54, which is mounted to the first frame 571, reaches a position immediately above the insert hole 52*a* of the pedestal 52, the first frame 571 moves downwards along the groove 573*a* of the third frame 573 while accompanying the second frame 572, and as shown in FIG. 18 and FIG. 19, the abovementioned nozzle 54 is thereby inserted inside the insert hole 551*a* of the main pressing member body 551 of the pressing member 55. Air from the air passage 541 of the abovementioned nozzle 54 is blown onto the center of the upper end of the wire group 51 projected upwards from the abovementioned insert hole 52*a* of the pedestal 52, thereby causing the wire group 51 to open up in radial directions (second step).

Figure 20:
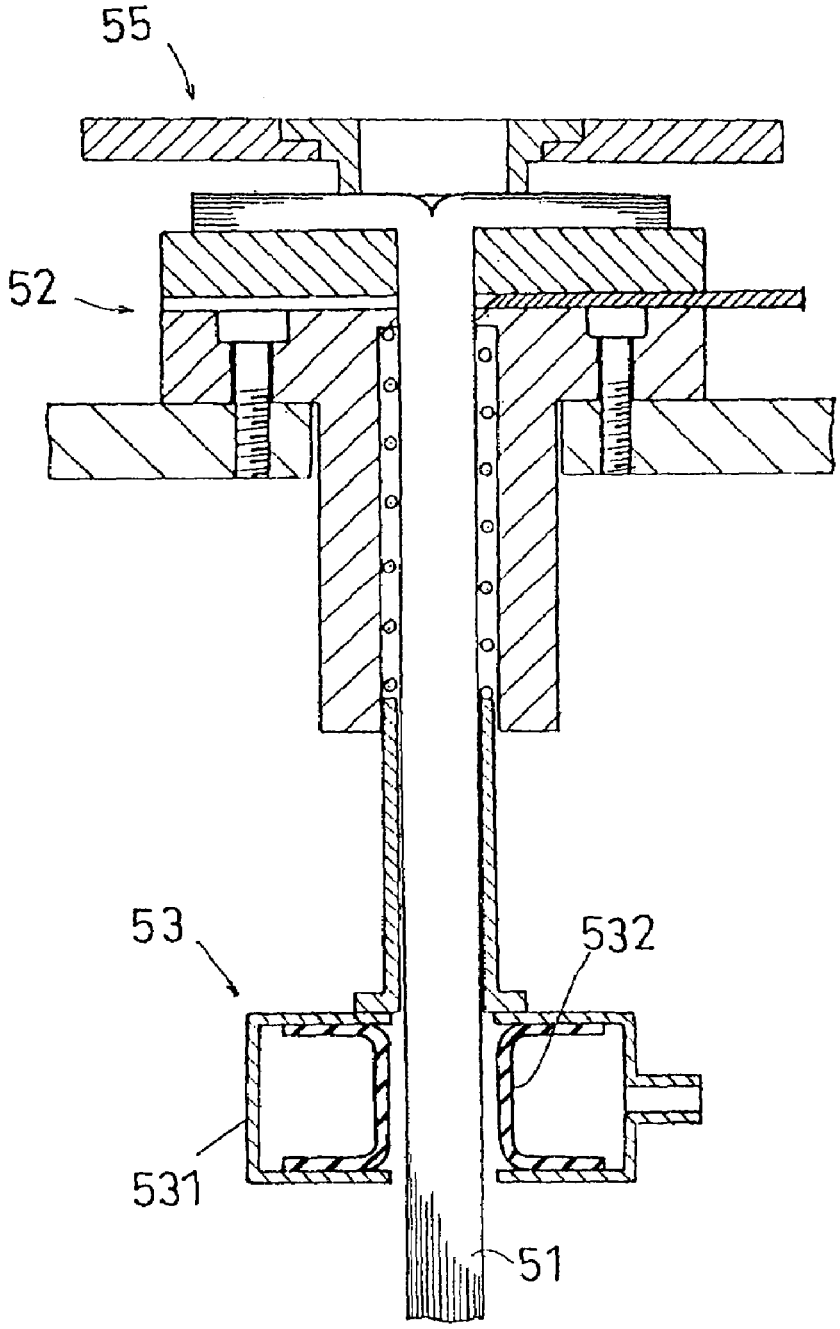
FIG. 20 is a sectional view showing a part of a third step.

Thereafter, the abovementioned pressing member 55 moves downwards. The wire group 51 is thereby fixed onto the pedestal 52 in the opened-up state by the pressing member 55 as shown in FIG. 20. Thereafter, the abovementioned first frame 571 moves upward along the groove 573*a* of the third frame 573 and the abovementioned nozzle 54 is retreated upwards. In the above-described states of FIGS. 17 to 19, the above-mentioned chuck 53 is at the upwardly-moved position. As shown in FIG. 20, when the wire group 51 is fixed onto the pedestal 52 in the opened-up state by the pressing member 55, the air inside the casing 531 of the abovementioned chuck 53 is discharged, the wire group 51 is released by the relaxing of the resilient member 532 in the interior, and in this state, the chuck 53 returns downward to its original position.

Figure 21:
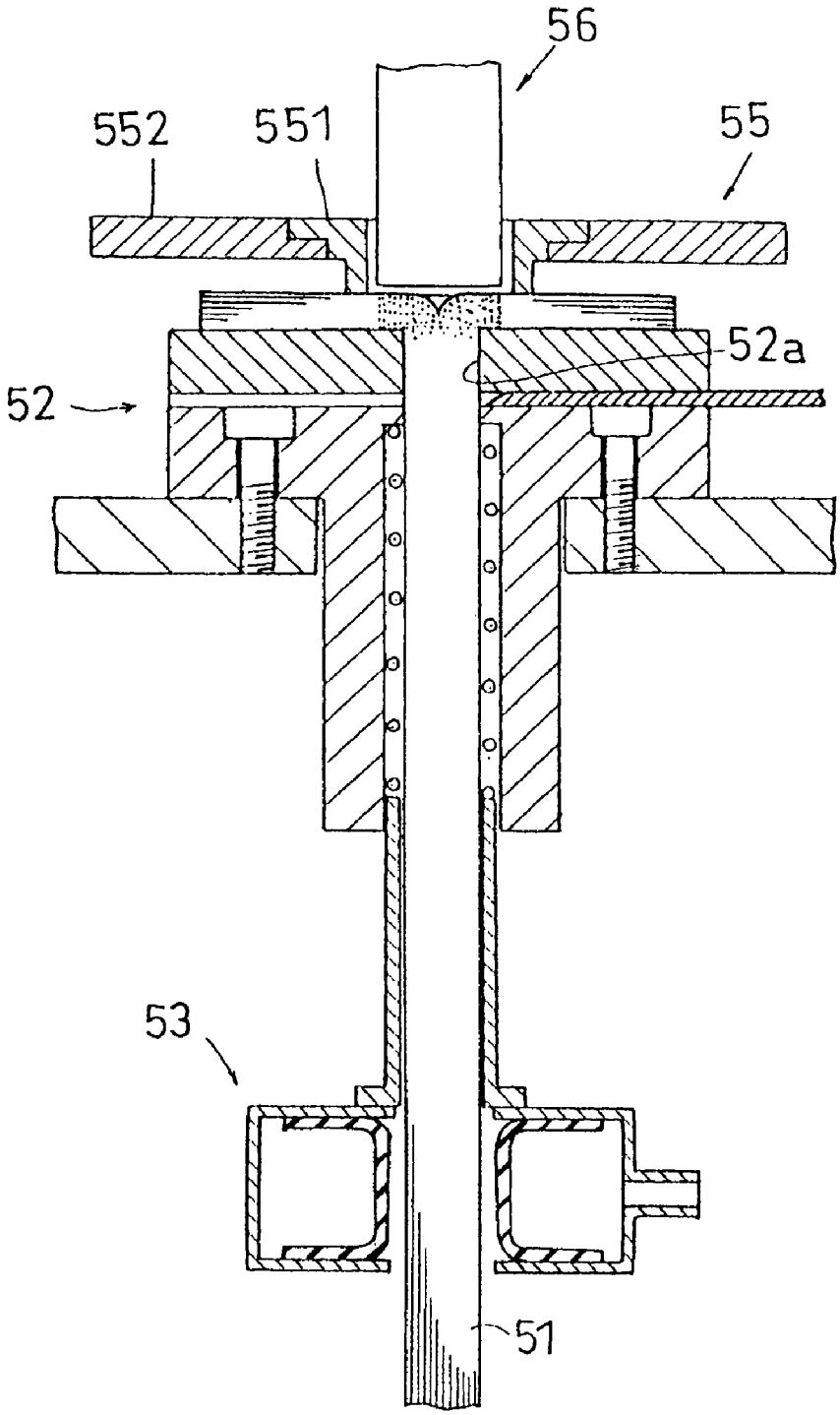
FIG. 21 is a sectional view showing a part of the third step.

Subsequently, the abovementioned first frame 571 of FIG. 15 moves in the transverse direction along the groove 572*a* of the second frame 572 until it contacts the right side limit position, and the abovementioned nozzle 54 is moved away from the pedestal 52 to the hypothetical line position shown in FIG. 15, and the welder 56 is moved to a position immediately above the wire group 51 on the pedestal 52. At this position, the first frame 571 moves downward again along the groove 573*a* of the third frame 573 while accompanying the second frame 572. The abovementioned welder 56 thus passes through the interior of the main pressing member body 551 of the pressing member 55 and descends to a position immediately above the center of the wire group 51 with the opened-up wire group 51 being fixed onto the pedestal 52 by the pressing member 55 as shown in FIG. 21, and a central part area of the opened-up wire group 51 is welded by the tip of the welder 56 (third step). A high-frequency welder is used for welding, and a circular area slightly larger in diameter than that of the insert hole 52*a* is welded.

Figure 22:
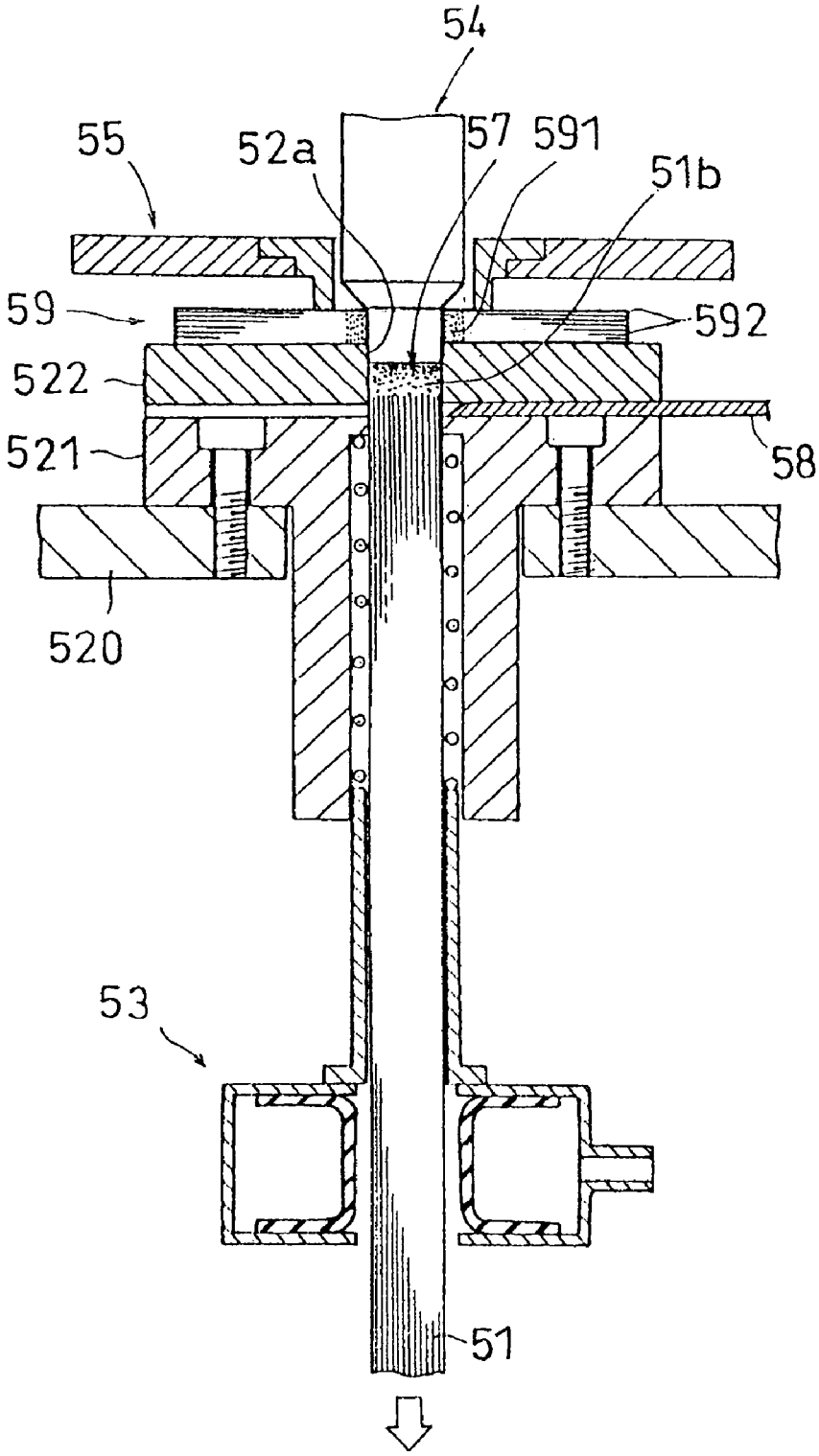
FIG. 22 is a sectional view showing a fourth step.

After welding, the abovementioned first frame 571 moves upward so that the welder 56 is retreated upwards from the pedestal 52 and pressing member 55 and returned to its original position, and then moves transversely so that the above-mentioned nozzle 54 is moved to a position immediately above the insert hole 52*a* of the pedestal 52. At this position, the second frame 572 moves downward along the groove 573*a* of the third frame 573 while accompanying the first frame 571. The tip of the abovementioned nozzle 54 is thereby passed through the insert hole 551*a* of the pressing body 55 and is inserted into a part of the insert hole 52*a* provided in the second member 522 of the pedestal 52. A center part of the welded part of the opened-up wire group 51 is cut off by the cut-off means 57 formed at the tip of the abovementioned nozzle 54, and the upper end of the insert hole 52*a* as shown in FIG. 22 (fourth step). An annular welded part 591 is left at the center of the opened-up wire group 51.

Thereafter, the nozzle 54 is retreated upward by the abovementioned second frame 572, and a sheet-form brush unit 59 having a hub (welded part) 591 at its center and having a plurality of bristles (wires) 592 projecting in radial directions from this hub 591 is thus formed on the above-mentioned pedestal 52. This brush unit 59 is taken out to the exterior by a pipe handling machine 510 as shall be described later.

When the center part of the welded part of the wire group 51 is cut off in circular form by the cut-off means 57 of the abovementioned nozzle 54 as shown in FIG. 22, since the cut-off means 57 is partly inserted inside the insert hole 52*a* formed in the second member 522 of the pedestal 52, the cut-off part 51*b* of the wire group 51 cut off remains pushed inside the insert hole 52*a* of the abovementioned second member 522. The cut-off part 51*b* is thus removed from the wire group 51 in the following step.

Figure 23:
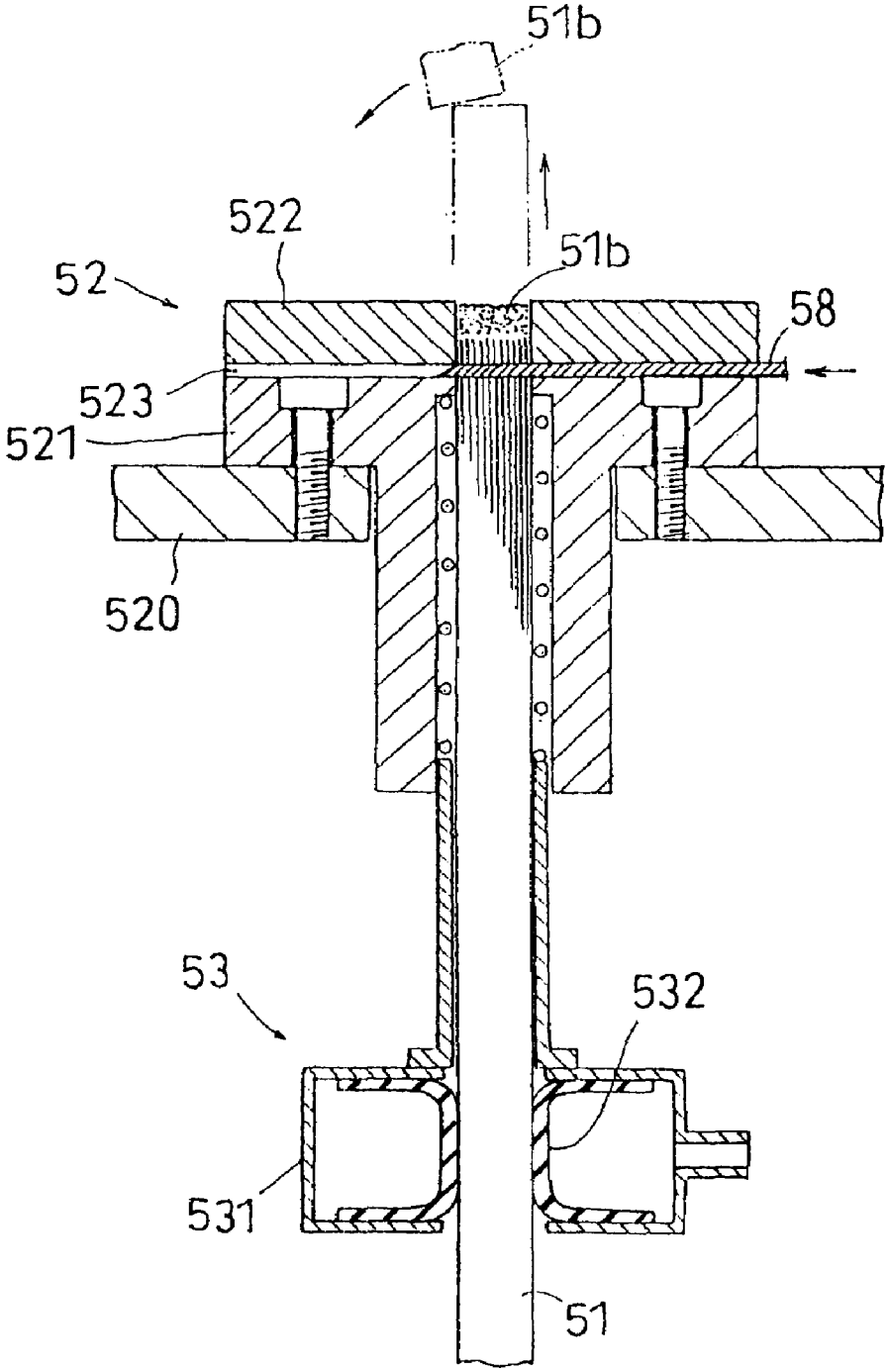
FIG. 23 is a sectional view showing a step of taking out a cut-off part of a wire group after the fourth step.

That is, the slide blade 58 advances along the slide groove 523 and cuts off a lower position of the cut-off part 51*b* as shown in FIG. 23.

Thereafter, the abovementioned slide blade 58 retreats, and as shown by the hypothetical line in FIG. 23, the wire group 51, accompanying the cut-off part 51*b*, is moved upward by the abovementioned chuck 53 to the position at which the specified amount thereof projects upwards from the insert hole 52*a* of the pedestal 52 shown in FIG. 17, and the cut-off part 51*b* is discarded at this point.

Here, though the welded cut-off part 51*b* of the wire group 51 tends to become attached to and remain inside the insert hole 52*a* of the pedestal 52, since the abovementioned slide blade 58 has the inclining face 580, which extends rearward from the blade edge in an upwardly inclining manner, formed at its tip, and a force in the direction of extracting the remaining welded part 51*a* of the wire group 51 from the insert hole 52*a* of the pedestal 52 is applied by this inclining face 580, even if the cut-off part 51*b* of the wire group 51 becomes attached to the insert hole 52*a* side, it can be pushed upward by the slide blade 58 to release the attached state.

The wire group 51 is grasped by the resilient member 532 inside the abovementioned chuck 53 being expanded by air, the wire group 511 is moved upward from the insert hole 52*a* of the pedestal 52 by the rising of the chuck 53 in this state, and the cut-off part 51*b* is also moved upward and can thus be taken out to the exterior speedily. The wire group 51 that follows the cut-off part 51*b* can thus be inserted into the insert hole 52*a* of the pedestal 52, and the transition to the next work step can be performed speedily.

Figure 24:
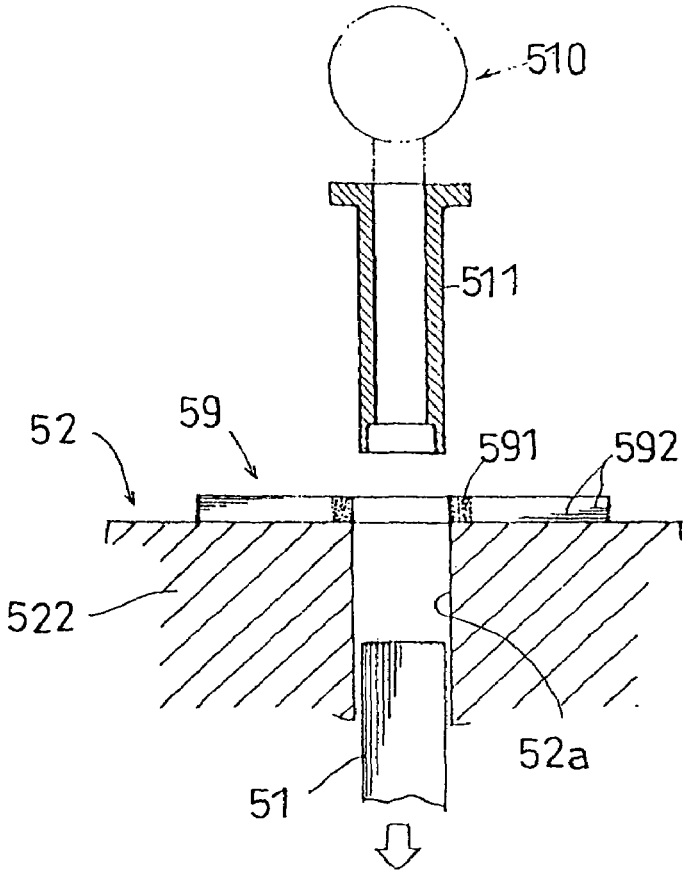
FIG. 24 is a sectional view showing a part of a step of taking out a manufactured brush unit to the exterior.
Figure 25:
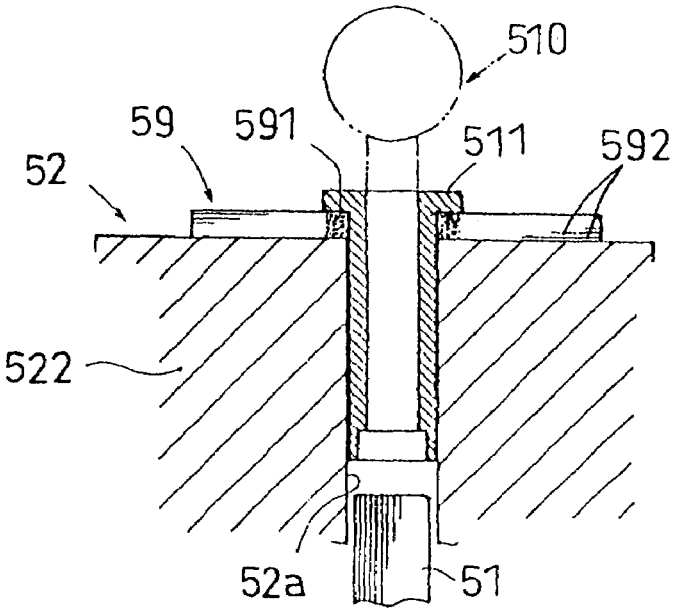
FIG. 25 is likewise a sectional view showing a part of the step of taking out the manufactured brush unit to the exterior.

After the abovementioned nozzle 54 retreats upward from the state of FIG. 22, the pipe handling machine 510, which is positioned in the vicinity of the abovementioned pedestal 52, is moved, while holding a core pipe 511, to a position immediately above the hub 591 of the brush unit 59 prepared on the pedestal 52 as shown in FIG. 24. Then as shown in FIG. 25, the core pipe 511 is inserted from the hub 591 into the insert hole 52*a* of the pedestal 52 by the descent of the abovementioned pipe handling machine 510, and the core pipe 511 is thus made to be inserted in and hold the brush unit 59.

Figure 26:
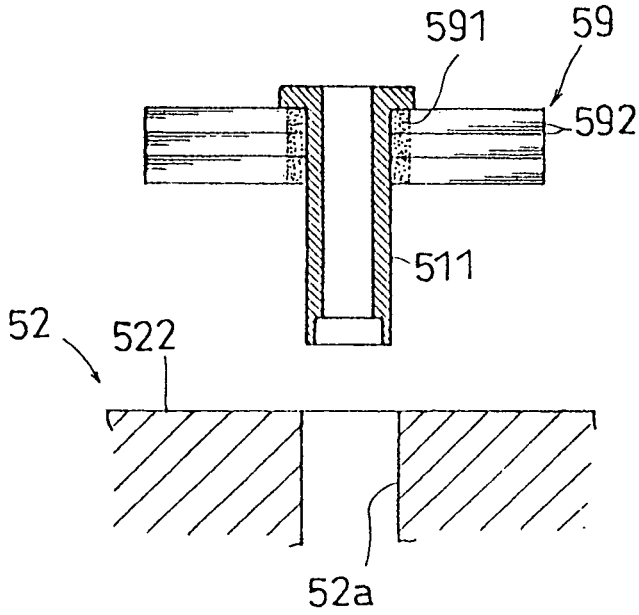
FIG. 26 is a sectional view showing a step of inserting and making a brush unit be held in a core pipe.

After the abovementioned core pipe 511 is made to insertingly hold the brush unit 59, the abovementioned pipe handling machine 510 rises, thereby taking out the brush unit 59 along with the core pipe 511 to the exterior of the pedestal 52, and the pipe handling machine 510 then waits at a predetermined upper position. Thereafter, the work steps of FIGS. 17 to 23 are repeated and the core pipe 511 is made to insertingly hold brush units 59 successively as shown in FIG. 26.

Then after the core pipe 511 is made to insertingly hold a predetermined number of the brush units 59, the core pipe 511 and the brush units 59 are removed from the pipe handling machine 510, and a new core pipe 59 is taken out from a holder and set in the pipe handling machine 510.

Figure 27:
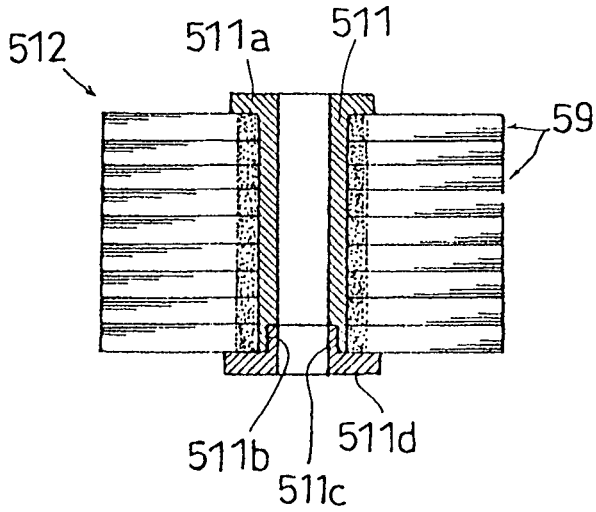
FIG. 27 is a sectional view of a rotary brush that is obtained.

Also after being taken out from the pipe handling machine 510, the brush units 59 are fixed to the core pipe 511 as shown in FIG. 27. With the embodiment of the figure, a core pipe 511, made of nylon or other thermoplastic resin and having a collar 511*a* formed integrally at one end in the length direction and an annular receiving groove 511*b* formed at the other end side, is used. From the receiving groove 511*b* side, the core pipe is inserted successively into the brush units 59 with the collar part 511*a* being positioned upward. Then after the predetermined number of the brush units 59 are held insertingly, a cylindrical lid 511*d* made of the same material as the core pipe 511 and having a protrusion 511*c* insertable in the abovementioned receiving groove 511*b*, is used, and the protrusion 511*c* thereof is inserted into the receiving groove 511*b*, and the predetermined number of brush units 59 are fixed onto the core pipe 511 by joining the lid 511*d* to the core pipe 511 by a sealing means using ultrasonic waves, etc., to prepare a rotary brush 512.

Figure 28:
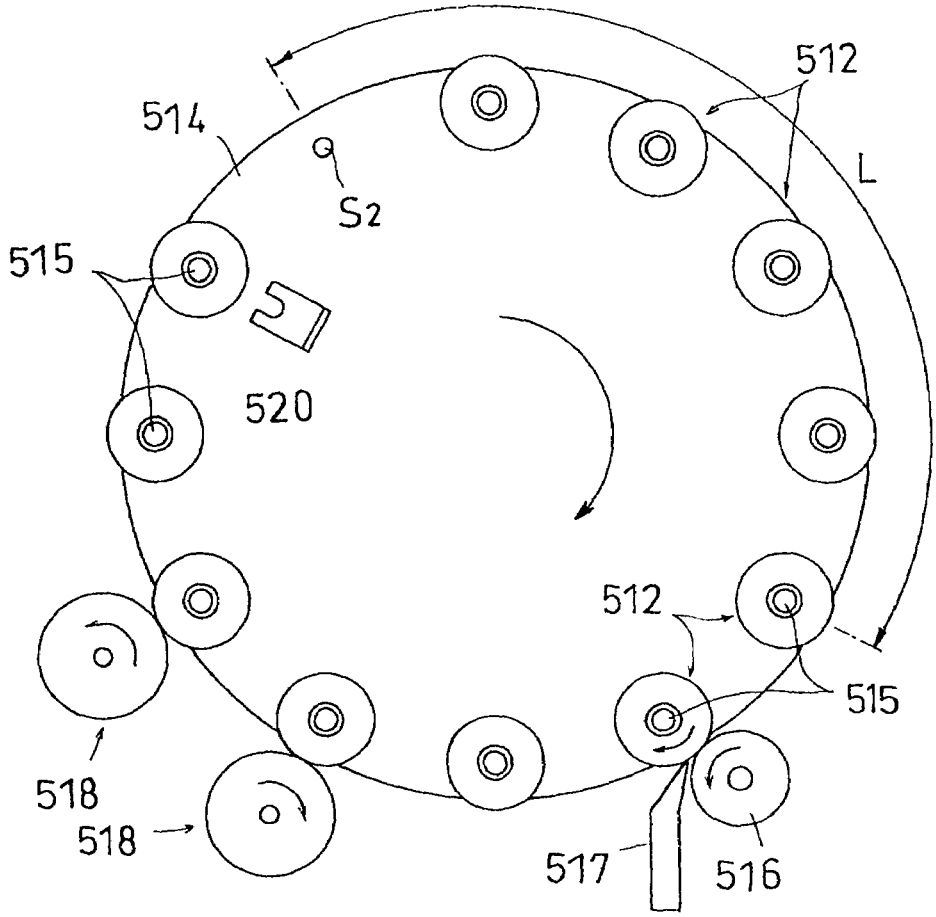
FIG. 28 is a plan view of a device used for post-processing of a rotary brush.
Figure 29:
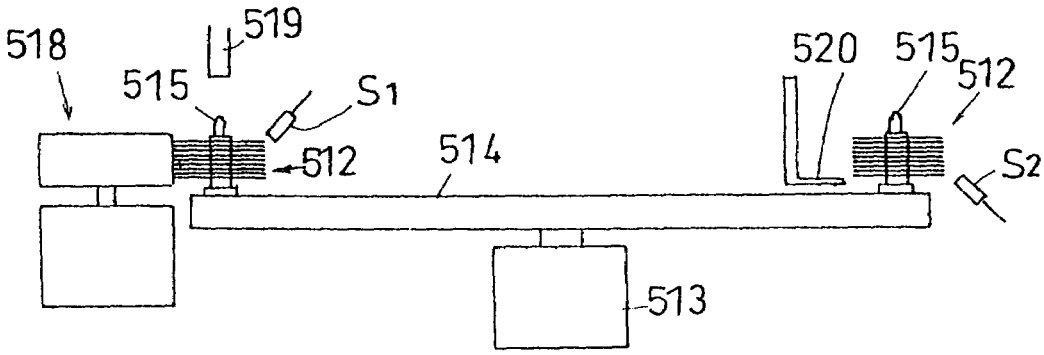
FIG. 29 is a side view showing the principal parts of the same device in an exploded manner.

FIG. 28 is a plan view of a device used for post-processing of the rotary brush 512 and FIG. 29 is a side view showing the principal parts of the same device in an exploded manner. In these figures, a plurality of pins 515 insertable into the core pipes 511 of the above-described rotary brushes 512 are protruded from the upper outer circumferential parts of a turntable 514 driven to rotate in the direction of the arrow by a motor 513. At outer peripheral positions of the turntable 514 are positioned a rubber roller 516, which contacts a rotary brush 512 in which a pin 515 is inserted, and a clipper or other cutter 517. With the rotary brush 512, in which the pin 515 is inserted, rotated by means of the abovementioned rubber roller 516, the tips of bristles 592 of each brush unit 59 of the rotary brush 512 are trimmed to uniform length by the abovementioned cutter 517.

Also, at positions of the turntable 514 rearward the cutter 517 in the direction of rotation are positioned two front and rear grinders or other finishing machines 518 that contact the tips of the bristles 592 of the rotary brush 512 in which the pin 515 is inserted. By forward rotation and reverse rotation of these finishing machines 518, the tips of the bristles 592 of the rotary brush 512 are rounded.

Furthermore with the embodiment of FIG. 29, a removal prevention member 519 for the rotary brush 512 is positioned above the finishing machines 518, and at a position of the turntable 514 rearward the finishing machines 518 in the direction of rotation is positioned a take-out machine 520, which takes out the finished rotary brush 512 from the pin 515. In the same figure, S1 is a sensor that checks the setting of a rotary brush 512 on a pin 515 and drives finishing machines 518, and S2 is a sensor for checking the taking out of a rotary brush 512 from a pin 515 by the take-out machine 520. In FIG. 28, L indicates the range along the turntable 514 in which rotary brushes 512 are set on pins 515.

Figure 30:
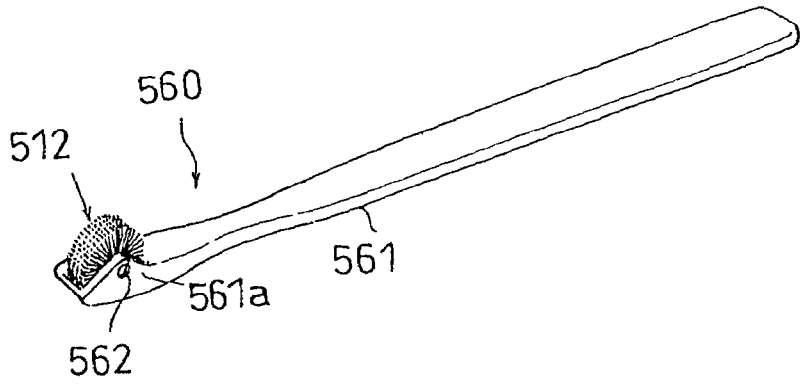
FIG. 30 is a perspective view showing a roll toothbrush with a rotary brush fitted.

FIG. 30 is a perspective view showing a roll toothbrush 560 fitted with a rotary brush 512 that has been obtained as described above. This toothbrush 560 is formed by the abovementioned rotary brush 512 being supported rotatably via a supporting shaft 562 at one end in the length direction of a handle member 561.

Figure 31:
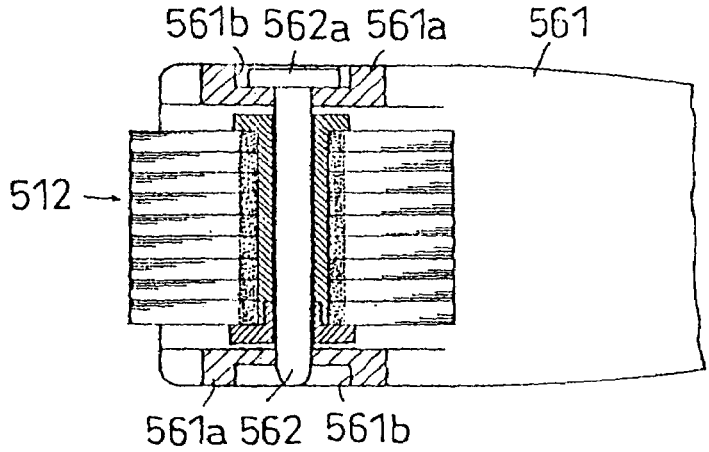
FIG. 31 is a sectional view for describing a state of setting a rotary brush in a roll toothbrush.
Figure 32:
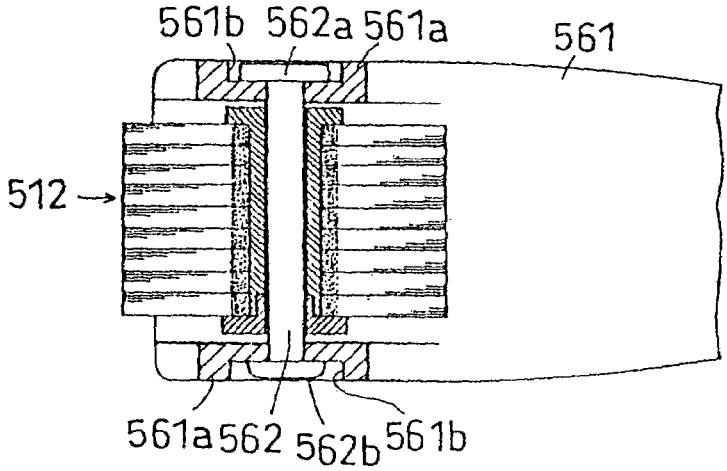
FIG. 32 is a sectional view of a state after setting.

FIG. 31 and FIG. 32 are sectional views for describing the states in which a rotary brush 512, which has been obtained as described above, is set in a handle member 561 of a roll toothbrush 560. First as shown in FIG. 31, the rotary brush 512 is interposed between supporting pieces 561*a* formed at both sides of one end in the length direction of the handle member 561 and then the supporting shaft 562 having a head part 562*a* is inserted from one supporting piece 561*a* to the other supporting piece 561*a* through the core pipe 511 of the rotary brush 512. The other end side of the supporting shaft 562 is thereafter squashed as shown in FIG. 32 so that the rotary brush 512 is rotatably supported in the handle member 561 via the supporting shaft 562.

With the embodiment of the respective figures, concaves 561*b* are formed in the respective supporting pieces 561*a* of the abovementioned handle member 561, and the head part 562*a* of the abovementioned supporting shaft 562 and the squashed part 562*b* at the other side are positioned in these concaves. The head part 562*a* of the abovementioned supporting shaft 562 is preferably made noncircular in shape and the above-mentioned concaves 561*b* of the supporting piece 561*a* that receives it is also preferably made noncircular in shape, and by arranging thus, the rotary brush 512 can be made to rotate smoothly about the supporting shaft 562.

INDUSTRIAL APPLICABILITY

As described above, since this invention enables the manufacture of brush units of uniform thickness and enables manufacture without requiring an advanced degree of skill, mass production is enabled. Since the overlapping of the wires can be lessened, the brush units can be manufactured efficiently at high speed and the uniformalization and mass production of rotary toothbrushes are enabled.

What is claimed is:

1. A device for manufacturing a brush unit for rotary brush, which is overlaid in plurality to form a rotary brush, comprising:

a pedestal having an insert hole through which a wire group formed by assembling together a plurality of wires in a bundle is to be passed;

a chuck for grasping the wire group and holding the wire group so that it projects from the insert hole of the pedestal by a specified amount;

a nozzle for blowing air into the center of the projected end of the wire group to open up the wire group in radial directions;

a pressing member for fixing the opened-up wire group to the pedestal;

a welder for welding a center portion of the wire group with the wire group fixed to the pedestal; and a cut-off means for cutting off a central part of the welded part welded by the welder.

2. The brush unit manufacturing device for rotary brush according to claim 1, wherein said chuck is formed of a casing and a cylindrical resilient member positioned in the interior of the casing, and arranged so that the resilient member is expanded or compressed by the supplying or discharge of air into or out from the interior of the casing to grasp or release the wire group that has been inserted into the interior.

3. The brush unit manufacturing device for rotary brush unit according to claim 1, wherein said nozzle is provided in the interior thereof with an air passage for blowing air into the central part of the projected end of the wire group and has said cut-off means formed on the tip thereof.

4. The brush unit manufacturing device for rotary brush unit according to claim 1, wherein said nozzle and welder are mounted on a single frame and arranged to be moved in the left/right and up/down directions via this frame.

5. The brush unit manufacturing device for rotary brush unit according to claim 1, wherein a slide blade for cutting and removing the remaining welded part of the wire group that has been cut by the cut-off means is mounted to said pedestal, and this slide blade is provided with an inclining face for applying a force in the direction in which the remaining welded part of the wire group is extracted from the pedestal.

6. A rotary brush manufacturing method comprising the steps of:

projecting, by a specified amount, a wire group formed by assembling together a plurality of wires in a bundle outward through an insert hole provided in a pedestal;

inserting a cone into the center of the projected end of the wire group to push open the wire group in radial directions;

welding a center portion of the wire group in an annular shape with the pushed-open wire group being fixed to the pedestal;

cutting the inner side of the annular welded part to form a brush unit having a hub at the center thereof and having a plurality of bristles projecting radially from the hub;

making a core pipe be inserted in and hold the hub of the brush unit;

taking the brush unit, together with the core pipe, out of the pedestal; and repeating these steps to make a plurality of brush units be held insertingly in the core pipe, thereby forming a rotary brush having a plurality of bristles projecting radially.

7. The rotary brush manufacturing method according to claim 6, wherein tips of the bristles of the rotary brush are trimmed to uniform length and subject to a finishing treatment.

8. A rotary brush manufacturing device comprising:

a pedestal having an insert hole through which a wire group formed by assembling together a plurality of wires in a bundle is to be passed;

a chuck for grasping the wire group and holding the wire group so that it projects outward from the insert hole of the pedestal by a specified amount;

a cone to be inserted into the center of the projected end of the wire group to push open the wire group in radial directions;

a pressing member for fixing the pushed-open wire group to the pedestal;

a welder for welding a center portion of the wire group in an annular shape with the wire group being fixed to the pedestal;

a cutting machine for cutting the inner side of the wire group while leaving the welded part to form a brush unit having a hub at the center thereof and having a plurality of bristles projecting in outwardly radial directions from the hub; and a pipe handling machine for making a core pipe be inserted in and hold the hub of the brush unit and taking out the brush unit, together with the core pipe, to the exterior of the pedestal.

9. The rotary brush manufacturing device according to claim 8, further comprising: a cutter for cutting the bristles of the rotary brush to uniform length while rotating the rotary brush; and a finishing machine, which rounds the tips of the bristles.

10. A roll toothbrush manufacturing method comprising the steps of: projecting, by a specified amount, a wire group formed by assembling together a plurality of wires in a bundle outward through an insert hole provided in a pedestal; inserting a cone into the center of the projected end of the wire group to push open the wire group in radial directions; welding a center portion of the wire group in an annular shape with the pushed-open wire group fixed to the pedestal; cutting the inner side of the annular welded part to form a brush unit having a hub at the center thereof and having a plurality of bristles projecting radially from the hub; making a core pipe be inserted in and hold the hub of the brush unit; taking out the brush unit, together with the core pipe, to the exterior of the pedestal; repeating these steps to make the core pipe insertingly hold a plurality of the brush units, thereby forming a roll-like rotary brush with a plurality of bristles projecting radially; and making the rotary brush be supported in a rotatable manner in a handle member.

11. A method for manufacturing a brush unit for rotary brush, which is overlaid in plurality to form a rotary brush, comprising:

a first step of projecting, by a specified amount, a wire group formed by assembling together a plurality of wires in a bundle outward through an insert hole provided in a pedestal;

a second step of blowing air into the center of a projected side of the wire group to push open the wire group in radial directions;

a third step of welding a center portion of the wire group with the opened wire group being fixed to the pedestal; and a fourth step of cutting off a central part of the welded center portion.

* * * * *